US005167352A

United States Patent [19]

Robbins

[11] Patent Number: 5,167,352

[45] Date of Patent: Dec. 1, 1992

[54] DOUBLE WALL TANK SYSTEM

[76] Inventor: Howard J. Robbins, 8561 El Paseo Grande, La Jolla, Calif. 92037

[21] Appl. No.: 577,768

[22] Filed: Sep. 5, 1990

Related U.S. Application Data

[63] Continuation-in-part of Ser. No. 483,332, Feb. 20, 1990, abandoned, which is a continuation of Ser. No. 171,252, Mar. 21, 1988, abandoned.

[51] Int. Cl.[5] ..... B65D 25/18

[52] U.S. Cl. ..... 220/402; 200/426; 200/450; 200/438; 200/440

[58] Field of Search ..... 220/402, 426, 450, 438, 220/440, 565, 464, 469; 73/49.2, 49.3; 340/605; 425/54; 137/312

[56] References Cited

U.S. PATENT DOCUMENTS

| | | | |
|---|---|---|---|
| 3,246,789 | 4/1966 | Progler | 220/442 |
| 3,322,141 | 5/1967 | Gans, Jr. et al. | 220/442 |
| 3,489,311 | 1/1970 | Folkents et al. | 220/450 |
| 3,606,067 | 9/1971 | Jones | 220/450 |
| 3,780,900 | 12/1975 | Yamamoto | 220/901 |
| 3,895,152 | 7/1975 | Carlson et al. | 220/901 |
| 3,921,438 | 11/1975 | Katsuta | 220/450 |
| 3,941,272 | 3/1976 | McLaughlin | 220/450 |
| 3,984,994 | 10/1976 | Ehle et al. | 220/426 |
| 4,230,061 | 10/1980 | Roberts et al. | 220/901 |
| 4,327,554 | 5/1982 | Patil et al. | 220/901 |
| 4,581,285 | 4/1986 | Mahehley, Jr. | 220/480 |
| 4,640,439 | 2/1987 | Palazzo . | |
| 4,644,627 | 2/1987 | Palazzo . | |
| 4,655,367 | 4/1987 | Palazzo . | |
| 4,676,093 | 6/1987 | Pugnace et al. | 220/426 |
| 4,744,137 | 5/1988 | Palazzo . | |
| 4,780,946 | 11/1988 | Palazzo . | |
| 4,780,947 | 11/1988 | Palazzo . | |
| 4,927,050 | 5/1990 | Palazzo . | |

FOREIGN PATENT DOCUMENTS

| | | | |
|---|---|---|---|
| 3521508 | 6/1985 | Fed. Rep. of Germany | 220/901 |

*Primary Examiner*—Joseph Man-Fu Moy
*Attorney, Agent, or Firm*—Albert L. Gabriel

[57] ABSTRACT

A full double wall tank, primarily for underground fluid storage, which is simpler and more economical to construct than conventional full double wall tanks. An inner tank shell, preferably of steel, provides primary fluid containment and is the principal structural basis of the tank. An intermediate barrier layer is applied over the inner shell to define secondary containment space, and provides a base for application of a resin outer secondary containment tank shell which is preferably fiber-reinforced. Monitor sensor means is provided having access to the secondary containment space, preferably proximate the bottom of the tank. The barrier layer is preferably such as to provide a minimum of fluid-receiving secondary containment space for rapid and highly sensitive monitoring, and to provide cathodic protection for a steel inner tank shell. A presently preferred barrier layer of metallic foil which has a higher electrode potential on the electromotive force series of elements than iron, such as aluminum foil, serves these functions. Alternatively, a generally inert, flowable medium, such as silicone oil, containing a substantially uniform suspension of metal having such higher electrode potential will also serve these functions. In the preferred form of the invention, one or more vertical, diametrical monitor pipe struts extend down through the cylindrical body of the tank providing monitoring access to the secondary containment space proximate the bottom of the tank, while at the same time adding greatly to the beam stiffness of the tank.

62 Claims, 11 Drawing Sheets

FIG. 10
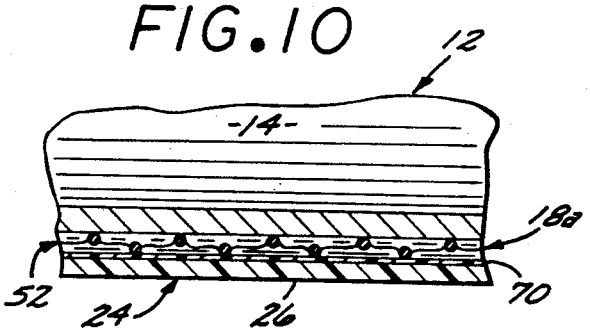
FIG. 11
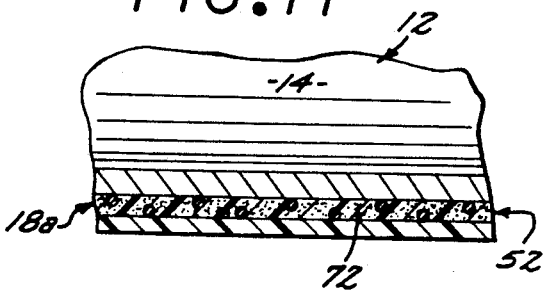
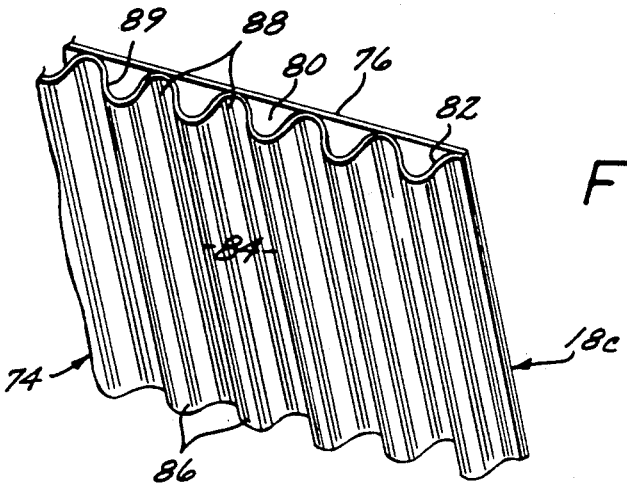
FIG. 12
FIG. 13
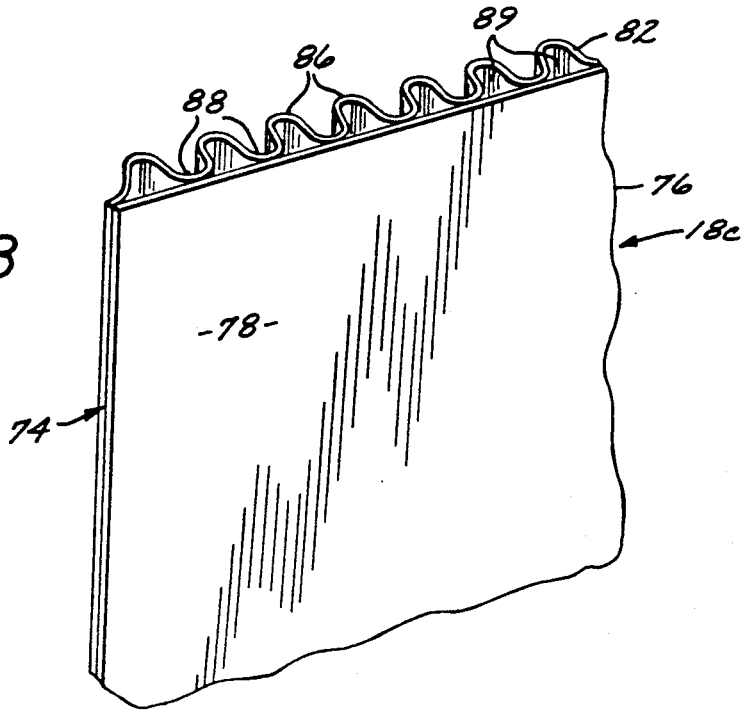

DOUBLE WALL TANK SYSTEM

RELATED APPLICATIONS

The present application is a continuation-in-part of Ser. No. 07/483,332, filed Feb. 20, 1990 now abandoned, which in turn is a continuation of Ser. No. 07/171,252 filed Mar. 21, 1988, now abandoned, both entitled "Double Wall Tank System."

BACKGROUND OF THE INVENTION

1. Field of the Invention

The present invention is in the field of tanks, principally for underground fluid storage such as fuel storage, and is particularly directed to double wall tanks comprising an inner tank structure, preferably of steel, for primary fluid containment, an outer tank structure, preferably made of fiber-reinforced resin, for secondary fluid containment, with interstitial space provided between the outer surface of the inner tank structure and the inner surface of the outer tank structure for secondary fluid containment in the event of leakage either outwardly through a breach in the inner tank structure or inwardly through a breach in the outer tank structure.

2. Description of the Prior Art

Regulations of many states and of the U.S. federal government currently require double wall construction for underground fluid storage tanks such as fuel storage tanks, in order to provide secondary fluid containment because of environmental considerations. Such double wall tank construction constitutes, in effect, an outer secondary containment tank shell supported about an inner primary containment tank shell. The inner tank shell defines the primary, inner chamber which provides primary containment for the fluid being stored, while space defined between the inner and outer tank shells, no matter how thin it may be, defines a secondary chamber which provides for secondary containment of the fluid in the event a leak should develop through the wall of the inner tank shell, as for example from corrosion, a faulty weld or resin bond, or from seismic or other mechanical stressing, or through the wall of the outer tank shell. One or more fluid-sensing monitors are conventionally located in communication with one or more low zones in the secondary containment space between the two tanks. Such fluid-sensing monitors are generally located proximate the bottom of the tank proximate end heads of the inner and outer tank structures, in at least one end of the tank, and preferably in both ends. Any leakage outwardly through a breach in the inner primary tank chamber into the secondary containment space, or inwardly through a breach in the secondary containment tank structure into the secondary containment space, is directed toward one or more monitor sensors which then provide an alarm signal to surface equipment indicating the leakage.

There are several different grades and types of underground storage tanks generally considered in the art to be of double wall construction currently in use in the United States, and these are almost all of cylindrical construction and adapted to be layed on their sides underground, i.e., have their cylindrical axes disposed generally horizontally. A full double wall tank consisting of two complete cylindrical tanks, one inside the other, is designated a "double wall" tank. This type of tank has double end walls and 360° double cylindrical wall protection. Most such full double wall tanks are fabricated of steel, although many such full double wall tanks currently produced are non-metallic, as for example having a wound filament fiberglass/resin construction. Improved secondary containment features are applied to such full double wall tanks in applicant's U.S. Pat. No. 4,685,585, issued Aug. 11, 1987, for "Double Wall Tank Manway System," and in applicant's U.S. Pat. No. 4,871,084, issued Oct. 3, 1989, for "Tank Secondary Containment System." While such full double wall tanks provide generally satisfactory secondary containment, they are time consuming and expensive to fabricate, since they require the construction of two complete tanks of different sizes, assembly of the smaller tank inside the larger tank, and welding or resin-bonding of fittings and manways to both the inner and outer tank shells.

Another type of tank which is not completely of double wall construction but is nevertheless commonly referred to as a double wall tank is known as a "wrap tank." In the wrap tank, the primary fluid holding tank is a cylindrical steel tank, with an outer steel sheet provided which gives double wall protection for approximately 330° around the lower part of the tank, leaving the top part of the tank with only the single wall protection of the primary tank. While wrap tanks are cheaper to construct than full double wall tanks, they do not provide secondary containment which is as effective, and regulations in many states such as California do not accept them as double wall tanks.

Another problem in the double wall tank art is that monitor sensing for fluid leakage is conventionally performed at the ends of the tank either between inner and outer end heads of the two tank shells or in external vertical pipes outside the end heads of the tank which extend downwardly from the top of the tank to the bottom and are in communication with the interstitial space between the two tank shells at the bottom of the tank. These are locations which are relatively remote from regions along the length of the tank where a breach would be likely to occur, as for example where pipe fittings and/or manways are welded to the tank structure. It would be desirable for more uniform sensing coverage of potential fluid leaks along the length of the tank to provide sensors at intermediate locations along the length of the tank in the bottom of the cylindrical interstitial space between inner and outer tank shells.

Another problem in the double wall tank art is that cylindrical underground tanks tend to be vulnerable to buckling and to inward collapse of the tank, i.e., implosion, commonly referred to as beam collapse, from external forces on the cylindrical wall of the tank which exceed the beam strength of the tank. This problem of beam collapse failure increases with increased lengths of the tanks, and is of considerable concern for very large underground cylindrical tanks which may be as long as 60 feet.

Another problem in the art is that where at least the inner primary containment tank structure is made of steel, which is usually the case, a breach in the outer secondary containment tank structure, usually of fiber-reinforced resin, will generally admit ground water to the secondary containment zone between the inner and outer shells, and this is likely to initiate corrosion of the inner steel shell. Virtually all of the prior art double wall tanks having monitoring space between the tank walls prior to the present invention have monitoring secondary containment space which is relatively large in volume, usually requiring the accumulation of many gallons of liquid in the secondary containment space before a monitor is energized. Because of this, a relatively small breach in the outer shell can admit water into the secondary containment space for a long period of time, even years, before a monitor sensor is energized, over which time a considerable amount of corrosion of the inner steel tank structure can occur. Similarly, with the usual relatively large volume of the secondary containment space, a breach in the inner tank structure may not be detected for a long period of time after the breach has initiated. Thus, it would be desirable to greatly reduce the volume of the secondary containment space capable of receiving fluid, so as to greatly reduce potential corrosion of a steel inner tank structure and greatly reduce the time required for monitor sensing and signalling after a breach has occured in either the inner primary containment tank structure or the outer secondary containment tank structure.

Regardless of how long a time interval may occur between a breach in the outer tank shell and the signalling of an alarm by a monitor sensor, entry of ground water through a breach in the outer shell can result in rapid initiation and progress of inner steel shell corrosion, particularly where the ground water is substantially acidic, which is a factor that cannot be predicted when a double wall tank is manufactured. In addition to other factors, ground water will frequently tend to be acidic because of dissolved carbon dioxide, making a carbolic acid solution. Therefore, specific protection for a steel inner tank structure against corrosion other than the protection afforded by a potentially breachable resin outer tank shell would be desirable.

Where a large steel structure is continuously immersed in water, such as a ship or drilling platform, zinc bars are conventionally provided proximate the water line as sacrificial anodes to provide cathodic protection for such structures. However, it would not be feasible to employ zinc bars in the narrow confines of the double wall tank secondary containment space, and in any event no practical deployment arrangement can be envisioned which would cover the entire area of the secondary containment space with zinc bars such as to be available for cathodic protection from a breach in the outer shell at any unpredictable location in the shell. Thus, it would be desirable to have cathodic protection for the inner steel tank which covers the entire area of the interstitial secondary containment space.

SUMMARY OF THE INVENTION

In view of these and other problems in the art, it is a general object of the present invention to provide a true full double wall tank which is simpler in construction and more economical to fabricate than conventional full double wall tanks that are made as separate tanks and assembled one inside the other.

Another object of the invention is to provide a novel full double wall tank construction requiring the separate fabrication of only a single primary tank shell, with the secondary containment space being defined by a barrier layer of spacing material which is layed over the primary tank shell, and with the outer secondary containment tank shell being a resin layer, preferably fiber-reinforced, which is layed over the intermediate barrier layer that defines the secondary containment space.

Another object of the invention is to provide, in a double wall tank structure, an intermediate barrier layer defining the space between inner and outer tank shells.

Another object of the invention is to provide, in a double wall tank structure, an intermediate barrier layer which serves as a base for the convenient application of an outer resin shell.

Another object of the invention is to provide a double wall tank structure of the character described, wherein the intermediate barrier layer between inner and outer tank shells comprises open-cell foam resin material.

Another object of the invention is to provide a double wall tank structure of the character described, wherein the intermediate barrier layer between inner and outer tank shells comprises channel mesh material.

Another object of the invention is to provide a double wall tank structure of the character described, wherein an intermediate porous layer of open-communication material is covered with a layer of vapor barrier sheet material for protecting the porous material both chemically and structurally during application of the outer resin shell of the tank.

Another object of the invention is to provide a double wall tank structure of the character described, wherein the intermediate barrier layer comprises one-sided corrugated sheet material having a grooved side and a generally flat-surfaced side, the one-sided corrugated sheet material being arranged with its grooved side facing the inner tank shell and the generally flat surfaced side facing outwardly as a supporting base for application of the fiber-reinforced resin outer shell.

Another object of the invention is to provide a double wall tank structure of the character described wherein the intermediate barrier layer comprises one-sided corrugated cardboard that has a substantially neutral pH so as to protect a steel inner tank structure from corrosion.

Another object of the invention is to provide a double wall tank structure of the character described, wherein the internal barrier layer between inner and outer tank shells comprises a material, such as one-sided corrugated cardboard having a substantially neutral pH, with the characteristic of dissolving or otherwise breaking down when exposed to a fluid potentially to be sensed such as a hydrocarbon liquid or its vapor, or water, whereby the fluid will be channeled to one or more monitor sensors proximate the bottom of the tank.

A further object of the invention is to provide, in a double wall tank structure, one or more generally vertically, diametrically oriented monitor pipe struts generally regularly spaced along the length of the tank, which extend from the top of the tank structure down through the interior of the inner tank shell to the bottom of the inner tank shell to provide monitoring access through one or more holes in the inner tank shell to the interstitial space at the bottom of the tank structure between the inner and outer tank shells, such monitor pipe strut or struts providing optimum sensing locations for leakage into the cylindrical interstitial space between inner and outer tank shells from a breach at any location along the length of the tank structure, while at the same time providing a great deal of added beam stiffness to the tank structure against inward collapse or buckling.

A further object of the invention is to provide a double wall tank of the character described having the monitor pipe strut means described in the preceding paragraph which, by providing added beam stiffness to the tank structure against inward collapse or buckling, enables the inner primary containment tank structure to be made with a substantially reduced wall thickness compared to that of prior art inner primary containment tank structures, thereby reducing material and handling costs.

A further object of the invention is to provide a double wall tank structure of the character described wherein the intermediate barrier layer is defined by metal foil, preferably aluminum foil, which is higher on the electromotive series than the iron from which a steel inner primary containment tank structure is made so as to provide cathodic protection to the steel inner tank structure over substantially its entire surface.

A further object of the invention is to provide a double wall tank structure of the character described wherein such cathodic protection may be provided by substantially uniform deployment throughout the interstitial secondary containment space between the inner and outer tank shells of any suitable metallic element that is higher on the electromotive series than iron, comprising such elements as aluminum, chromium, zinc, beryllium and magnesium, which may be applied in foil sheet form, or in particulate form substantially uniformly suspended in a generally inert, noncorrosive carrier such as silicone oil to which monitor sensors are not responsive.

A still further object of the invention is to provide a double wall tank structure of the character described wherein an aluminum foil intermediate barrier layer between the inner and outer tank shells defines fluid flow interstitial space between the inner and outer tank shells which is extremely small over the entire tank, whereby only a very small amount of fluid penetrating into the interstitial space from a breach in either the inner tank structure or the outer tank structure is required to energize one or more monitor sensors, rendering the monitoring function very sensitive and rapid.

Yet a further object of the invention is to provide a double wall tank structure of the character described wherein an overlapping aluminum foil barrier layer defining the interstitial spacing between inner and outer tank shells, sealed by adhesive aluminum foil tape and resin of the outer tank shell, provides a vapor barrier surrounding the inner primary containment tank shell which is substantially impervious to hydrocarbon vapors, thereby enabling a substantial reduction of the thickness, and hence cost, of the outer secondary containment tank shell.

An additional object of the invention is to provide a double wall tank structure of the character described wherein the secondary containment space between the inner and outer tank shells is defined by a noncorrosive, flowable medium such as silicone oil to which monitor sensors are not responsive.

According to the invention, the fabrication of a double wall tank structure which qualifies as a full double wall tank is greatly simplified and made much more economical than conventional full double wall tanks, by having only a single primary tank shell, preferably made of steel, but alternatively made of fiber-reinforced resin, which is the inner fluid containment shell; defining the secondary containment space with a barrier layer applied over the outside of the primary tank shell; and making the outer secondary containment tank shell by applying a resin layer, which is preferably fiber-reinforced, over the intermediate barrier layer. This novel system requires the fabrication of only a single primary tank shell, which forms the basis for both the interstitial secondary containment space as defined by the intermediate barrier layer and the outer secondary containment shell.

The presently preferred intermediate barrier layer is overlapped aluminum foil sheeting, which has important advantages over all prior art devices for spacing an outer secondary containment tank shell outwardly from an inner primary containment tank shell in a double wall tank system. First, elongated aluminum foil sheeting is easily applied to the cylindrical portion of the inner tank shell by applying it in overlapping circular hoops, or by helically winding it off of a spool onto the cylindrical shell body, and then trimming the ends at the end heads of the inner tank shell. Second, during fabrication of the double wall tank, the overlapping aluminum foil sheeting functions as a resin barrier preventing resin that is applied to form the outer secondary containment tank shell from bonding to the inner primary tank shell, thereby preserving the integrity of the secondary containment space and area between the two tank shells. Third, the overlapping aluminum foil sheeting, sealed at the overlaps by adhesive aluminum foil tape and resin of the outer tank shell, provides an excellent hydrocarbon vapor barrier, enabling a substantial reduction in thickness, and hence cost, of the outer secondary containment resin tank shell. Fourth, by defining the secondary containment space by means of aluminum foil sheeting, which generally abuts directly against the outer surface of the inner tank shell and the inner surface of the outer tank shell, only a very narrow fluid flow space exists on both sides of the aluminum foil, which can even go down to microscopic dimensions, yet any fluid escaping outwardly from the inner tank shell or inwardly from the outer tank shell will rapidly seep or be ducted down through the secondary containment space to one or more monitor sensors proximate the bottom of the double wall tank. This minimized operative secondary containment space enables monitor sensors to be energized by only a very small amount of escaping fluid, which greatly increases monitoring rapidity and sensitivity. Fifth, the aluminum foil sheeting, having a substantially higher electrode potential on the electromotive series of elements than iron of which an inner steel tank is principally composed, provides cathodic protection against corrosion for a steel inner tank shell against ground water which may penetrate inwardly through a breach in the outer resin secondary containment tank shell.

While such aluminum foil sheeting is the presently preferred intermediate barrier layer, sheeting of other elements that are higher on the electromotive series than iron may alternatively be employed, such as chromium, zinc, beryllium, or even magnesium if that is carefully handled.

Cathodic protection for a steel inner primary containment tank shell may alternatively be provided by employing an intermediate barrier layer of a flowable, generally inert noncorrosive medium such as silicone oil which has a substantially uniform suspension therein of particulate metal that is higher on the electromotive series than iron, including such metals as aluminum, chromium, zinc, beryllium and magnesium. A suitable such flowable medium is a mold release agent employed in the fabrication of fiberglass-reinforced boat hulls. If cathodic protection is not desired, the generally inert flowable medium such as silicone oil may still be employed effectively as the intermediate barrier layer between the inner and outer tank shells.

Another type of intermediate barrier layer material is sheet material having the characteristic of dissolving or otherwise structurally breaking down when exposed to a fluid potentially to be sensed, such as a hydrocarbon liquid fuel or its vapor, or water. A suitable material of this type is one-sided corrugated cardboard. An important aspect of the corrugated cardboard is that it have a substantially neutral pH, as distinguished from the substantially acidic nature or ordinary packaging cardboard. Such substantially neutral pH corrugated cardboard is commercially available. If a fluid leak occurs from a breach at any location in the tank, the fluid will progressively dissolve or otherwise break down the material of the intermediate layer, channeling a flow of fluid to one or more monitor sensors proximate the bottom of the tank. With one-sided corrugated cardboard as the intermediate porous layer, the cardboard is arranged with its grooved side against the outside of the inner tank shell, and its flat side facing outwardly to form a base or platform for application of the fiber-reinforced resin of the outer shell. With the corrugated cardboard grooves facing the inner tank shell, fluid from a breach in the inner tank shell will freely flow through the corrugation grooves, and will also flow between the corrugation ridges and the inner tank shell, to one or more monitor sensors, and the dissolving or otherwise breaking down of the cardboard by the fluid will expedite the fluid flow to the monitor or monitors. As an alternative, the one-sided corrugated sheet may be made of a material, such as a resin material, which does not have the characteristic of dissolving or otherwise breaking down in the presence of a fluid to be sensed. As with the corrugated cardboard, fluid from a breach in the inner tank shell will freely flow through the corrugation grooves, and will also flow between the corrugation ridges and the inner tank shell, to one or more monitor sensors proximate the bottom of the tank structure.

In one form of the invention, preferably but not necessarily with the overlapping aluminum intermediate barrier layer, one or more monitor sensors are strategically located at one or more intermediate locations along the length of the tank structure, being exposed to the cylindrical interstitial space between inner and outer tank shells proximate the bottom of the tank structure. Such placement is accomplished by providing one or more substantially vertical, diametrical monitor pipe struts extending from the top of the tank structure down through the primary fluid containment space in the inner tank shell to the bottom of the inner tank shell where they are exposed through one or more respective holes in the inner tank shell to the cylindrical interstitial secondary containment space in the bottom of the tank structure. Preferably, one or more of such monitor pipe struts are substantially regularly spaced along the length of the inner tank structure such that the inner tank structure will be divided into "beam" lengths not more than about ten feet between each end head of the tank and a strut, and between struts along the length of the inner tank shell. Assuming that a pair of such monitor pipe struts is located at substantially regularly spaced locations along the length of the tank structure; i.e., spaced approximately equidistant from the ends of the tank structure and from each other, structurally the tank is, in effect, thereby made of three sections having approximately equal length. This adds greatly to the beam strength of the tank against implosion of the cylindrical portion of the tank in any direction, and against buckling, while at the same time providing adequate space for most types of monitors. Such increased strength of the inner primary containment tank shell enables it to be made with substantially thinner walls than conventional inner tank shells, thereby reducing material and handling costs. A monitor sensor is lowered from the top down through each of the monitor pipes to a location proximate the cylindrical secondary containment space in the bottom of the tank.

The intermediate barrier layer may alternatively be made of porous sheet materials other than one-sided corrugated cardboard, such as open-pore foam resin material or channel mesh resin sheet material, either of which may have a vapor barrier sheet over its outside to protect the porous material from the fiber-reinforced resin of the outer shell when it is being applied.

All forms of the invention are adapted to have pipe fittings and manways which extend through all three layers of the tank sandwich, which are bonded and sealed as by welding to the inner tank shell, and bonded and sealed by resin bonding to the outer tank shell.

BRIEF DESCRIPTION OF THE DRAWINGS

These and other objects and advantages of the present invention will become more apparent from the following detailed description taken in conjunction with the drawings, wherein:

FIG. 10 is a view similar to FIGS. 4 and 9, illustrating vapor barrier sheet material in covering relationship over the channel mesh sheet material;

FIG. 11 is a view similar to FIGS. 4, 9 and 10, illustrating the channel mesh sheet material permeated with open-cell foam material;

FIG. 12 is an enlarged, fragmentary perspective view illustrating a form of the intermediate barrier layer of the invention composed of one-sided corrugated sheet material such as one-sided corrugated cardboard having a substantially neutral pH, looking generally toward the open-grooved side of the corrugated sheet material;

FIG. 13 is an enlarged, fragmentary perspective view of the one-sided corrugated sheet barrier layer of FIG. 12 looking toward its other side, namely, toward the single flat supporting lamination thereof;

DETAILED DESCRIPTION

In each of the forms of double wall tank structure of the invention, there is a primary containment inner tank shell that is preferably fabricated from mild steel but may alternatively be made of fiber-reinforced resin, an outer secondary containment tank shell preferably made of fiber-reinforced resin, and an intermediate barrier layer which synergistically serves at least two functions: (1) during fabrication, the intermediate barrier layer serves as a resin barrier to prevent resin from bonding to the inner, primary tank shell during application of the fiber-reinforced resin to make the outer, secondary containment tank shell, thereby preserving the integrity of secondary containment space between the inner and outer tank shells; (2) provides secondary containment space for capturing any fluid which may escape outwardly through a breach in the inner primary containment tank shell, or inwardly through a breach in the outer secondary containment tank shell, and provides flow space and area for conducting any such fluid to one or more fluid monitors.

Figure 1:
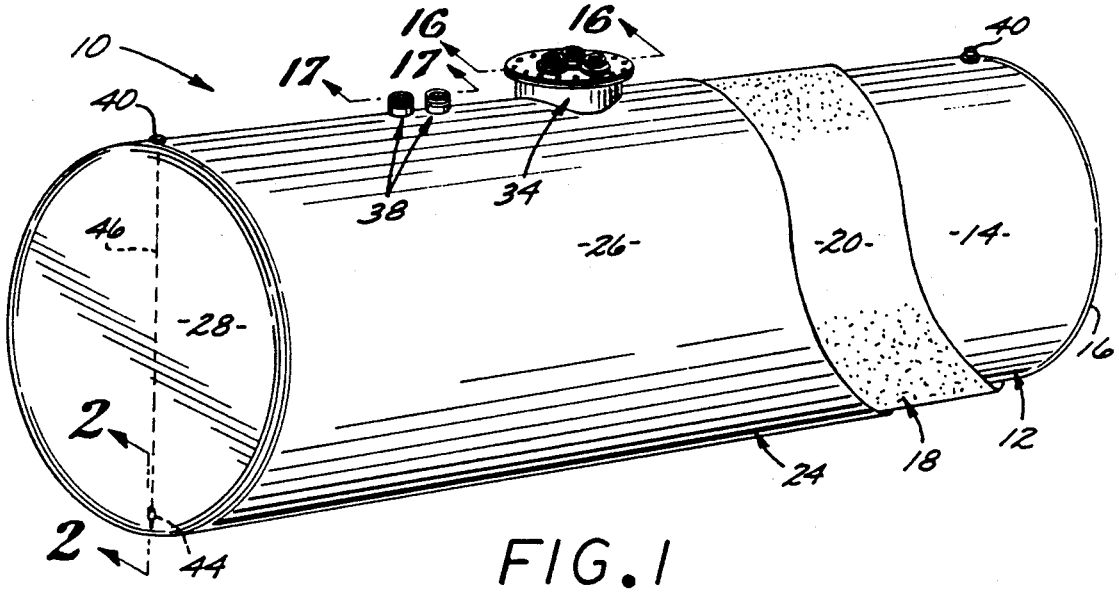
FIG. 1 is a perspective view, with portions broken away, of a tank embodying a three-layer sandwich-type construction according to the invention, comprising an inner primary tank shell, an intermediate continuous-communication barrier layer of porous material defining secondary containment space, and an outer secondary containment tank shell layed over the intermediate porous layer.
Figure 2:
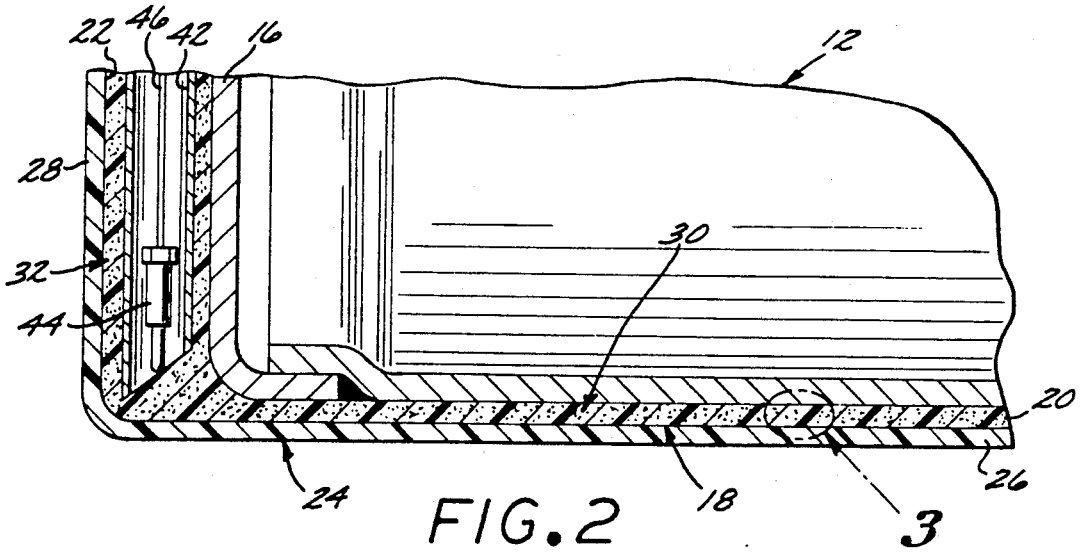
FIG. 2 is an enlarged, fragmentary vertical, axial section, partly in elevation, taken on the line 2—2 in FIG. 1, illustrating internal details of construction of the tank shown in FIG. 1.
Figure 3:
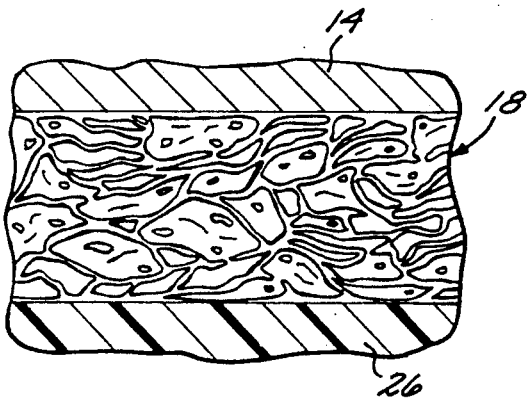
FIG. 3 is an even further enlarged fragmentary, vertical, axial section of the encircled portion of FIG. 2 designated "3," diagrammatically illustratiing an open-cell foam resin form of the intermediate barrier layer forming a part of the invention.

FIGS. 1-3 illustrate one form of double wall tank structure according to the invention, generally designated 10. Double wall tank 10 has an overall generally right circular cylindrical configuration as is typical for underground storage tanks, such as those normally employed for the storage of hydrocarbon fuels such as gasoline and diesel fuel. Double wall tank 10 is illustrated in FIG. 1 in the position in which such tanks are normally located underground, i.e., layed on their sides with their cylindrical axes disposed generally horizontally. It is to be understood, however, that the present invention is equally applicable for use with tanks of other overall configurations, orientations, and locations.

The primary structural basis of double wall tank 10 is a rigid, fluid-tight inner primary tank shell 12 which will normally be fabricated of steel, but which may alternatively be fabricated of fiber-reinforced resin embodying resin and fiber materials which are currently conventionally in use in the manufacture of some underground tanks. Inner tank shell 12 has a cylindrical body portion 14, and a pair of end heads 16.

In the form shown in FIGS. 1-3, an intermediate barrier layer of porous material is applied over the entire primary tank shell 12. Thus, the intermediate porous barrier layer, which is generally designated 18, includes a cylindrical portion 20 overlying inner cylindrical body 14, and end head portions 22 overlying the heads 16 of inner tank shell 12. The intermediate porous barrier layer 18 may consist of any open-communication or open-cell material which will allow the free flow of both liquid and gas throughout its entire extent. Porous barrier layer 18 may be characterized as a layer of solid material which has continuously communicating interstitial spaces. In the form of the invention shown in FIGS. 1-3, the open-communication material of porous barrier layer 18 is an open-cell foam resin material which may, for example, be made of open-cell polyurethane or open-cell high density polyethylene. The material of which porous barrier layer 18 is made is preferably a material which is not soluble in the resin of which the outer wall of double wall tank 10 is made. Thus, during fabrication of double wall tank 10, porous barrier layer 18 serves the function of being a resin barrier to prevent resin from bonding to the inner, primary containment tank shell 12 during application of the outer, secondary containment resin shell, thereby preserving the integrity of secondary containment space and area between the inner and outer tank shells. The outer wall or shell of tank 10 may typically be made of a polymer such as polyester, epoxy or polyurethane, and neither open-cell polyurethane nor open-cell high density polyethylene are soluble in these outer shell materials.

The open-cell foam resin material may be layed on in sheets over inner tank shell 12, being suitably taped or otherwise bonded in position pending application of the outer tank shell over it, or alternatively may be sprayed onto the outside of inner primary tank shell 12. A sufficient thickness of the open-communication filler material is applied over inner tank shell 12 to assure that enough space is provided between the inner and outer tank shells for free flow of both liquid and gas throughout the space between the inner and outer tank shells. Approximately ⅛th inch thickness of porous barrier layer 18 has been found to provide satisfactory results, and is convenient to handle during application. However, it is to be understood that barrier layer 18 may be thinner or thicker, provided there is adequate fluid flow space, and the material is manageable during application. In the form of the invention shown in FIGS. 1-3, a fluid-sensing monitor is to be placed proximate the bottom of tank 10 between the inner and outer tank shell heads in at least one end of the tank, and preferably in each end of the tank, and if such monitor or monitors are wider than cylindrical portion 20 of the porous barrier layer, then to accommodate such fluid-sensing monitor or monitors, the head or end portion 22 of intermediate porous layer 18 at one or both ends of tank 10 may be made thicker than the cylindrical portion 20, as for example up to approximately 1½ inches thick, as illustrated in FIG. 2.

Porous barrier layer 18 provides a solid foundation for convenient direct application of the outer tank shell resin material without the complications and expense involved in the manufacture and assembly of two separate tanks with intervening space, while nevertheless providing the same benefit of free flow space for fluid to flow from a breach at any point in a tank shell to one or more fluid-sensing monitors in the bottom of the tank structure.

A rigid, fluid-tight outer secondary-containment tank shell 24 is applied directly over the entire intermediate porous barrier layer 18, outer shell 24 having a cylindrical body 26 which covers the cylindrical portion 20 of porous layer 18, and having end heads 28 which cover the end head portions 22 of porous layer 18. Outer tank shell 24 is made of resin material which is preferably but not necessarily fiber-reinforced, and is preferably sprayed over the intermediate porous layer 18. The resin material of outer shell 24 may be polyester, epoxy, polyurethane, or other suitable resin material. The fiber reinforcement may include glass fibers, graphite fibers, Kevlar fibers, metal fibers, or other suitable strengthening fibers. The fiber reinforcement may consist of chopped fibers, fiber matting, filament winding, or a combination of these. A suitable fiber-reinforced resin material for outer tank shell 24 is a fiberglass-reinforced resin material employed for coating steel tanks made by Joor Manufacturing, Inc. of Escondido, Calif. Such fiberglass-reinforced resin coated steel tanks are sold under the trademark "Plasteel." Outer tank shell 24 is provided for the purpose of secondary fluid containment, and is not needed for adding structural strength to tank 10, the basic structural strength being provided by the inner primary tank shell 12. Thus, outer shell 24 may be relatively thin, as for example approximately 0.10 inch.

With outer tank shell 24 thus applied directly over the outer surface of intermediate porous barrier layer 18, cylindrical secondary containment space 30 is defined between inner tank shell 12 and outer tank shell 24 which is filled with the porous material of intermediate layer 18; and head space 32 is defined at each end of tank 10 between inner shell heads 16 and the respective outer shell heads 28, such head spaces 32 being filled with the porous material of layer 18. These secondary containment spaces 30 and 32 between inner and outer shells 12 and 24, respectively, are primarily for the purpose of entrapping liquid and/or gas leakage from the inside of inner tank shell 12 outwardly, but will also entrap liquid and/or gas leakage which might occur from the outside of outer shell 24 inwardly. A breach in inner tank shell 12 causing such leakage might be from corrosion, a faulty weld or resin bond, or from seismic or other mechanical stressing.

To avoid damage to intermediate porous barrier layer 18 and outer secondary containment shell 24 during their successive applications over primary tank shell 12, it is preferable to support primary shell 12 at several points, preferably at or proximate its ends, for rotation about its cylindrical axis. The tank may then be rotated during application of the porous layer 18 and outer shell 24 to facilitate such applications. For this purpose, support ears or tabs (not shown) may be welded to inner tank shell 12, and if desired may be left in place for tank handling after tank 10 has been completed, with intermediate porous layer 18 extending around such ears, and outer tank shell 24 also extending around such ears and being resin-bonded and sealed thereto. Such application system may be usefully employed with all forms of the present invention. Presently preferred apparatus and method for supporting the tank for rotation during fabrication is shown in FIGS. 19–27, and described in detail in connection with those figures.

Double wall tank 10 made as described hereinabove is a true composite in construction, and may be considered as a "sandwich tank" wherein intermediate porous barrier layer 18 is sandwiched between inner and outer tank shells 12 and 24, respectively.

Underground storage tanks for hazardous and flammable materials such as fuels require access pipe fittings which extend through the top of the tank from the outside into the primary containment chamber within the tank, and most of such fittings have function pipes connected thereto which extend upwardly to surface equipment. Typically for the storage of fuels such as gasoline and diesel fuel, there are at least five such function fittings required, including a fill fitting, a turbine fitting for fluid extraction, a fitting for gauging, a vent fitting, and a vapor recovery fitting. A manway 34 is seen in FIG. 1, and is preferably a double wall type manway which may have a plurality of such pipe fittings 36 extending therethrough. Several forms of such double wall manways, including forms embodying pipe fittings, are disclosed in applicant's U.S. Pat. No. 4,685,585, issued Aug. 11, 1987, for "Double Wall Tank Manway System." Manway 34 extends through all three layers of the tank sandwich, and its construction and mounting are described hereinafter in detail in connection with FIG. 16. A pair of additional pipe fittings 38 which extend directly through all three layers of the tank sandwich are also seen in FIG. 1, and their mounting is described in detail hereinafter in connection with FIG. 16.

A monitor fitting 40 extends through the outer two layers of tank 10 at its top, at least proximate one end of tank 10, and preferably proximate each end as seen in FIG. 1. Each monitor fitting 40 is bonded and sealed to the outer cylindrical body 26 by resin bonding. A monitor pipe 42 is attached to each fitting 40, as by welding, and extends down through head space 32. A monitor sensor 44 is lowered on its electrical cable 46 down through each fitting 40 and its respective pipe 42 to a location proximate the bottom of head space 32, cable 46 extending upwardly to surface readout equipment.

Monitor sensors 44 may be of any type well known in the art which are adapted to sense the presence of liquids such as hydrocarbon fuels contained in tank 10, or their fluid vapors, or water, or other fluids. Any fluid which escapes outwardly from within inner tank shell 12 through a breach at any location in shell 12 will flow into either the cylindrical space 30 or a head space 32 between inner and outer tank shells 12 and 24, respectively, and because of the continuously communicating interstitial spaces within porous barrier layer 18, including the corners between the cylindrical and head portions of tank 10, will flow downwardly and longitudinally through spaces 30 and 32 to the sensor or sensors 44, and the breach will thereby be reported through cable or cables 46 to surface monitoring equipment. Similarly, any liquid or gas which may pass through a breach in outer tank shell 24 from outside shell 24 inwardly into the cylindrical space 30 or a head space 32 will flow downwardly and longitudinally to the sensor or sensors 44 and be reported to surface equipment.

Structurally, the open-cell foam of intermediate porous barrier layer 18 is selected to have sufficient compressive structural strength in the transverse or thickness direction of layer 18 to support outer shell 24 against anticipated compressive forces. For underground tanks, such anticipated forces are caused by the weight of the tank itself and of liquid contents therein, the pressure of earth or backfill material against the outside of the tank, and downward forces from proximate ground level, including the possible weight of a concrete service station pad, and the weight of vehicles on the pad.

Figure 4:
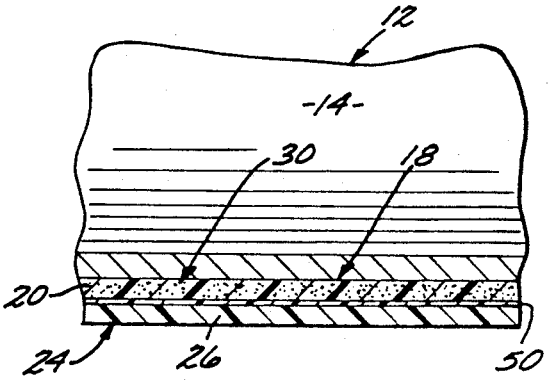
FIG. 4 is a fragmentary axial, vertical section similar to a portion of FIG. 2, illustrating an alternative form of the invention which has vapor barrier sheet material over the outside of the intermediate porous barrier layer to protect the intermediate porous barrier layer during application of the fiber-reinforced resin outer shell of the invention.
Figure 5:
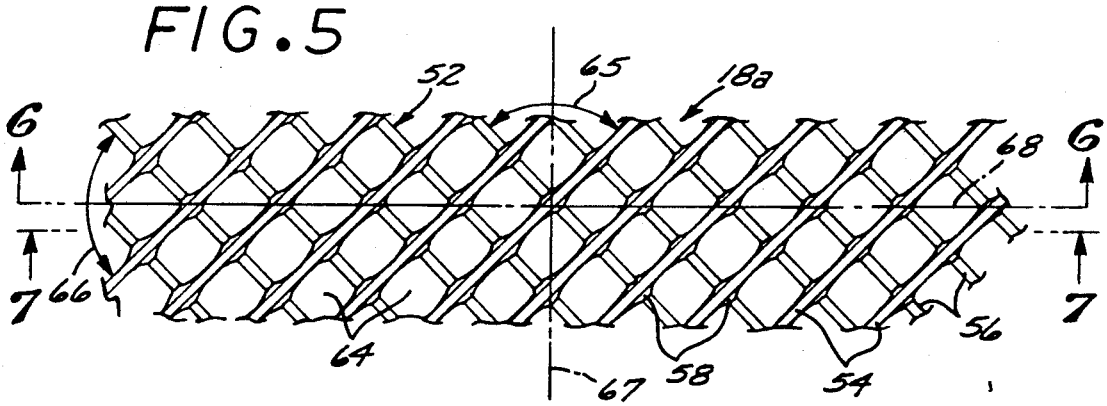
FIG. 5 is a fragmentary plan view illustrating an alternative intermediate barrier layer of the invention comprising channel mesh sheet material.
Figure 6:
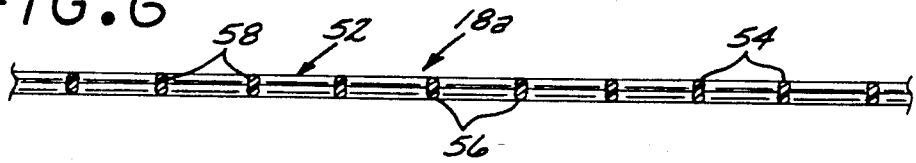
FIG. 6 is a fragmentary sectional view taken on the line 6—6 in FIG. 5.
Figure 7:
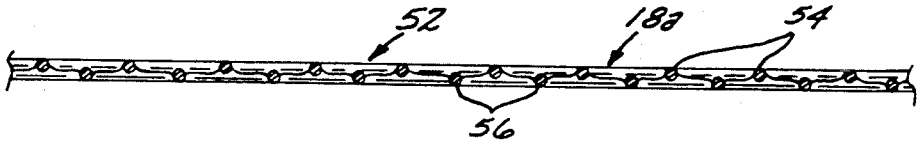
FIG. 7 is a fragmentary sectional view taken on the line 7—7 in FIG. 5.
Figure 8:
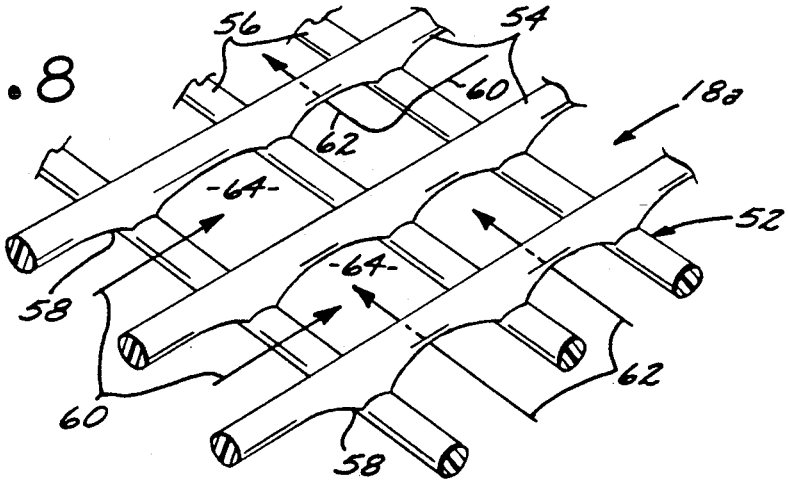
FIG. 8 is an enlarged fragmentary perspective view of the channel mesh sheet material of FIGS. 5–7, with arrows indicating flow paths through the channel mesh material.

An alternative sandwich construction which will assure that whatever open-cell foam material is used for porous layer 18 will not be dissolved by the resin of outer shell 24 regardless of what resin material the open-cell foam is made is illustrated in FIG. 4. In this form of the invention, a vapor barrier sheet 50 is applied over the entire intermediate porous layer 18 before application of the fiber-reinforced resin of outer shell 24, vapor barrier sheet 50 constituting a part of barrier layer 18 in the completed double wall tank 10. Suitable materials for the vapor barrier sheet 50 are waxed paper or Saran Wrap. The vapor barrier layer 50, by assuring that whatever open-cell foam is used will not dissolve, even partially, in the resin of outer shell 24, assures that the open-cell foam will not lose any of its porosity and hence its fluid flow capacity. It also assures that the open-cell foam will not lose any of its generally uniform structural capacity for uniformly supporting outer tank shell 24. It further permits porous layer 18 to be selected from a wider variety of materials.

FIGS. 5–9 illustrate an alternative intermediate porous barrier layer **18*a* which is made of "channel mesh" sheet material. Channel mesh porous sheet 18*a* is preferably an integral structure composed of a resin material that will not dissolve in the resin of which outer tank shell 24 is composed, as for example polyurethane or high density polyethylene. Channel mesh material is intrinsically very strong in the transverse or thickness direction of the sheet, which is the direction of compression between inner and outer tank shells 12 and 24**, respectively.

The channel mesh sheet material employed as intermediate porous barrier layer **18*a* is generally designated 52, and consists of a series of spaced, parallel inner ribs 54 which, with sheet 52 in its operative position, engage against the outer surfaces of inner tank shell 12; and a series of spaced, parallel outer ribs 56 which cross over inner ribs 54 in overlying relationship, and which in the operative position of sheet 52 engage against the inner surfaces of outer tank shell 24. Inner and outer ribs 54 and 56, respectively, are bonded to each other at their intersecting junctures 58. A series of parallel inner flow channels 60 is defined between adjacent pairs of inner ribs 54; and a similar series of parallel outer flow channels 62 is defined between adjacent pairs of outer ribs 56. Flow openings or pores 64 in the thickness direction of channel mesh sheet material 52 are defined between intersecting pairs of inner ribs 54 and pairs of outer ribs 56 over the entire extent of channel mesh sheet material 52. The intersecting inner ribs 54 and outer ribs 56 intersect at relatively wide angles 65 and 66, as for example at right angles. In one example of channel mesh material analyzed by applicant, the intersecting angles 65 between ribs 54 and 56 were approximately 75° in one angular direction and angles 66** approximately 105° in the orthogonal angular direction, which would be suitable for the present invention.

The overlapping parallel inner flow channels 60 and parallel outer channels 62, together with the transverse flow openings or pores 64, provide generally wide-open continuously-communicating interstitial spaces throughout channel mesh 52 for freedom of liquid and gas fluid flow throughout channel mesh sheet material 52 in the generally flat direction. For optimum fluid flow characteristics through channel mesh porous core 18*a*, the channel mesh is preferably oriented with one of its angular directions indicated by direction lines 67 and 68 generally circumferentially oriented between tank cylindrical bodies 14 and 26, and generally vertically directed between inner and outer tank heads 16 and 28 at the ends of tank 10. This orientation of channel mesh sheet material 52 provides equal angles of incidence relative to vertical of the flow channels 60 and 62 for uniformity of both vertical and longitudinal flow through cylindrical space 30 between inner and outer shells 12 and 24, respectively, and head spaces 32 between the heads of shells 12 and 24, respectively. Nevertheless, any orientation of channel mesh sheet material 52 will provide adequate flow characteristics for satisfactory operation of the invention.

Normally, a single thickness of channel mesh sheet material 52, which may be approximately ⅛th inch thick or thicker, will provide satisfactory fluid flow communication throughout cylindrical space 30 and end head spaces 32. A wire sensor-type fluid monitor currently well known in the art is sufficiently thin to be efficiently used in connection with such single thickness of channel mesh material. If desired, such a wire sensor may be deployed vertically in head space 32 at one or both ends of tank 10, extending from a monitor fitting at the top of the tank down to proximate the bottom of the tank. Alternatively, such a wire sensor may extend from a monitor fitting at the top of one end of tank 10, vertically down through head space 32 at that end, and then continue lengthwise along the bottom of tank 10 through cylindrical space 30 to the other end of tank 10. Such a wire sensor 69 is seen extending lengthwise in space 30 in FIG. 9. Because of the open fluid communication provided by pores 64 in the thickness direction of channel mesh sheet material 52, such wire sensors may be strung against either inner ribs 54 or outer ribs 56 of the channel mesh.

Figure 18:
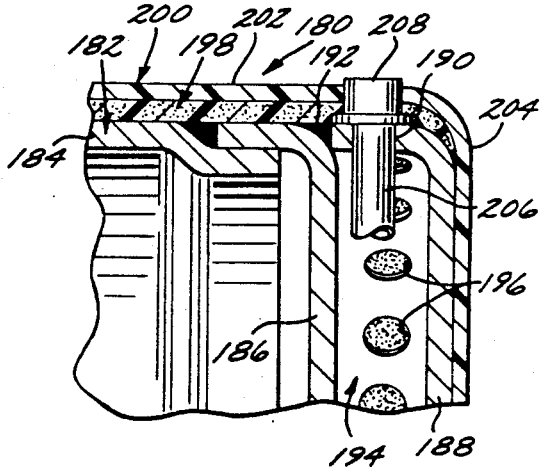
FIG. 18 is a fragmentary axial, vertical section, with portions shown in elevation, illustrating a further form of the invention embodying a double head construction with monitoring space defined between the two heads.

If monitor sensors are to be employed which are substantially wider than the wire sensor, then axially enlarged head spaces 32 may be filled with open-cell foam material as in the form of the invention shown in FIGS. 1–3; or alternatively, such enlarged head spaces may be open spaces as in the form of the invention shown in FIG. 18.

If desired, a vapor barrier sheet like the barrier sheet 50 of FIG. 4 and described in connection therewith may be placed in covering relationship over the entire channel mesh sheeting 52 of porous barrier layer 18*a*, as illustrated in FIG. 10, so as to effectively become a part of barrier layer 18*a*. This will not only enable a larger variety of channel mesh materials to be employed, but also will keep the resin material of outer shell 24 from entering the channels and pores of the channel mesh material and thereby interfering with any of the freedom of fluid flow therethrough.

A further alternative porous barrier layer 18*b* embodying channel mesh sheet material 52 is illustrated in FIG. 11. In this form, open-cell foam material 72 like that previously described in connection with FIGS. 1–3 is sprayed into the channels and pores of channel mesh sheet material 52, preferably after channel mesh sheeting 52 has been installed on the outside of inner tank shell 12, but if desired, this could be done before channel mesh material 52 is installed on the tank, as for example with the channel mesh sheeting layed out on a flat surface. In this alternative form of the invention, the high structural strength of the channel mesh material in the transverse or thickness direction is obtained, while the generally smooth and uniform surface characteristics of the open-cell foam filling keeps any of the resin material of outer shell 24 from entering channels or pores of channel mesh sheet material 52.

If desired, a vapor barrier sheet like sheet 50 of FIG. 4 and sheet 70 of FIG. 10 may be placed over the porous layer 18*b* of FIG. 11, so as to effectivel become a part of barrier layer 18*a*.

Open-cell foam filling 72 of channels and pores of channel mesh sheet material 52 in FIG. 11 may be considered as the primary porous filler layer 18*b*, and the channel mesh sheet material as matrix-reinforcement thereof. Alternatively, if desired, fiber reinforcement may be provided for the open-cell foam of porous layer 18 in the first form of the invention illustrated in FIGS. 1–3.

Figure 14:
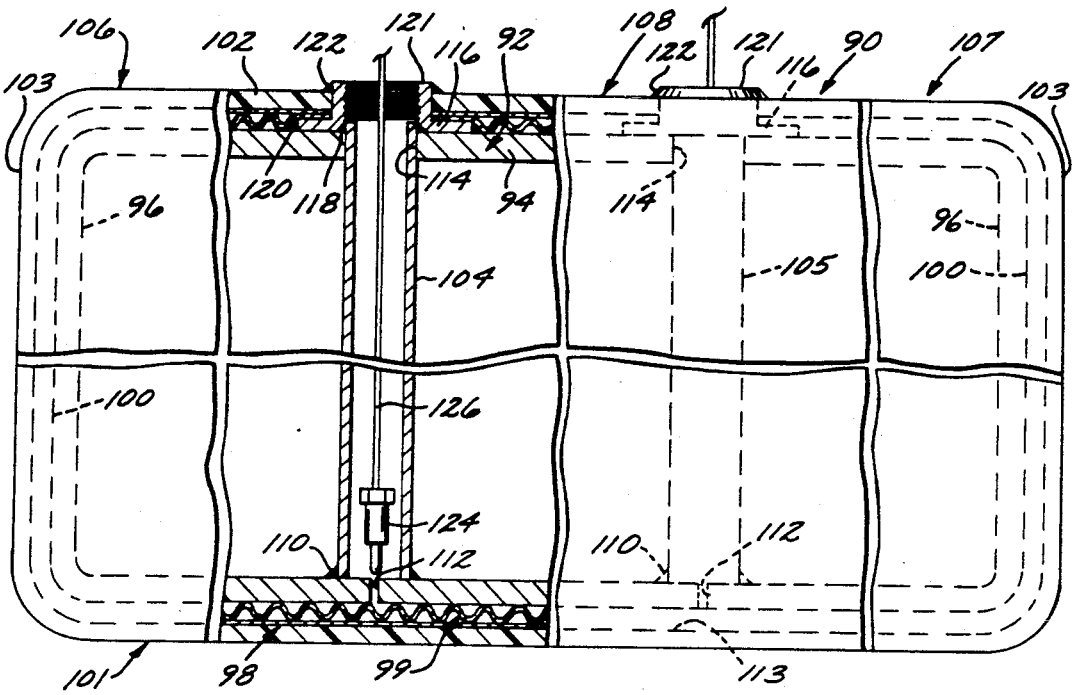
FIG. 14 is a fragmentary side elevational view, with a portion shown in axial, vertical section, of a tank construction according to the invention which embodies a pair of vertical, diametrical monitor pipes regularly spaced along the length of the tank to provide access for monitor sensors to be lowered downwardly therethrough to monitoring locations proximate the cylindrical secondary containment space proximate the bottom of the tank, while at the same time the monitor pipes provide added beam stiffness to the tank.
Figure 15:
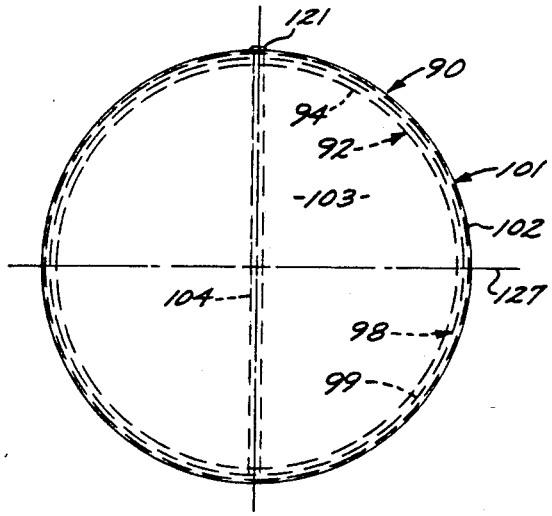
FIG. 15 is an end elevational view of the tank shown in FIG. 14, with the three sandwiched layers of the tank shown in phantom lines, and with one of the monitor pipes also shown in phantom lines.

FIGS. 12–13 illustrate a further alternative intermediate porous barrier layer 18*c* which is composed of one-sided corrugated sheet material generally designated 74, which is preferably one-sided corrugated cardboard; and FIGS. 14 and 15 illustrate an alternative double wall tank construction embodying such intermediate porous layer 18*c*. The one-sided corrugated sheet material 74 has a single flat supporting lamination 76 which has an exposed flat side 78 and a covered side 80 to which the corrugated lamination 82 is bonded. The corrugated lamination 82 has an exposed side 84 which consists of alternating, parallel ridges 86 and grooves 88.

Corrugated sheet material 74 is layed over the entire outer surface of inner tank shell 12, including its cylindrical body 14 and heads 16, with the exposed corrugated side 84 facing inner tank shell 12. The one-sided corrugated sheet material 74 may be tack-bonded at spaced locations as required to the outer surfaces of inner tank shell 12 in preparation for application of the fiber-reinforced resin material of outer tank shell 24 over the exposed flat side 78 of flat supporting lamination 76. Preferably, but not necessarily, the exposed flat side 78 is roughened to better hold the resin of outer tank shell 24 when the resin is applied.

It is an important feature of this form of the invention that the flat supporting lamination 76 face outwardly relative to inner, primary tank shell 12. With this orientation of corrugated sheet material 74, the outer secondary containment tank shell 24 of fiber-reinforced resin is assured of having a substantially uniform thickness, and that none of the resin will penetrate corrugated sheet material 74 which, if such were to occur, could partially block fluid flow through the secondary containment space between the two tank shells, and require that unnecessary extra resin be supplied.

Where the corrugated sheet material 74 employed in this form of the invention is corrugated cardboard, it is very important that the cardboard have a substantially neutral pH, so that it cannot be instrumental in the initiation or perpetuation of corrosion of an inner primary containment tank shell made of steel. Conventional corrugated cardboard is considerably acidic, and its use could cause substantial corrosion problems for a steel inner primary containment tank shell.

When the sandwich is complete of inner tank shell 12, one-sided corrugated sheet material 74, and outer tank shell 24, grooves 88 of corrugated sheet 74 which face inner tank shell 12 provide open channels to receive and conduct any liquid or gas which may flow through a breach in inner tank shell 12 from within to without inner tank shell 12. Fluid will also flow between corrugation ridges 86 and inner tank shell 12.

Testing has proven one-sided corrugated cardboard for porous layer 18*c* to have adequate strength in the thickness direction for supporting outer secondary containment tank shell 24 in spaced relationship about inner primary tank shell 12 during normal operative use of a double wall tank 10, maintaining cylindrical space 30 and head spaces 32 between the tank shells for receiving fluid that may enter space 30 or spaces 32 from a breach in either inner shell 12 or outer shell 24. Nevertheless, one-sided corrugated cardboard has the advantageous characteristic of dissolving or breaking down structurally when exposed to a fluid potentially to be sensed, such as a hydrocarbon liquid fuel or its vapor, or water. Such dissolving or breaking down of the one-sided corrugated cardboard material expedites the flow of fluid from a breach in a tank shell to one or more monitor sensors because the fluid will channel its way downwardly through the interstitial space between tank shells 12 and 24, dissolving or breaking down the one-sided corrugated cardboard as the fluid flows. Nevertheless, the one-sided corrugated cardboard material in other regions of the interstitial space between tank shells 12 and 24 will maintain the integrity of spaces 30 and 32 between the two shells so as to allow free-flow spacing for the fluid to flow to the sensor or sensors.

Figure 9:
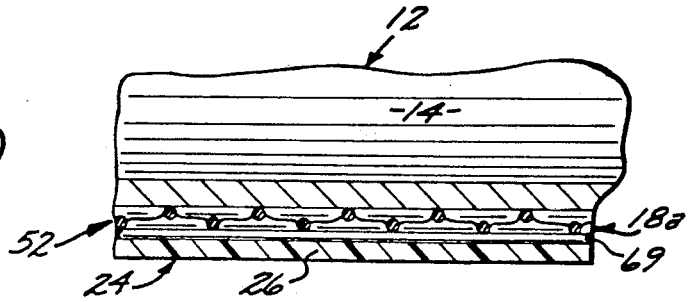
FIG. 9 is a view similar to FIG. 4, illustrating the channel mesh material of FIGS. 5–8 operatively disposed between the inner and outer tank shells, with a wire-type sensor extending generally axially along the secondary containment space adjacent the channel mesh material.

Accordingly, one-sided corrugated cardboard may be considered as an example of a generic type of sheet material for intermediate porous layer 18*c* having the characteristic of dissolving or otherwise structurally breaking down when exposed to a fluid potentially to be sensed, such as a hydrocarbon liquid fuel or its vapor, or water. With one-sided corrugated cardboard as this intermediate porous layer 18*c*, the direction of orientation of the grooves relative to the tank structure is optional, since the material will dissolve or break down, channeling the flow to one or more sensors. However, if desired, grooves 88 of the one-sided corrugated cardboard may be oriented to specifically direct the flow of fluid from a breach to one or more sensors even before the cardboard dissolves or breaks down. Thus, for example, if a wire sensor like wire sensor 69 described in connection with FIG. 9 is employed, extending down through one of the head spaces 32 and then longitudinally along the bottom of the tank through cylindrical space 30, then it would be desirable to orient corrugation grooves 88 vertically in head spaces 32 and generally circumferentially in cylindrical space 30, for channeling the fluid flow from a breach in the inner tank shell by the most direct possible route to the wire sensor. To obtain optimum benefit from such direct channeling of fluid from a breach when using a wire-type sensor, it is preferred to dispose the wire sensor in a groove 88 both in end space 32 and in the bottom of cylindrical space 30. Nevertheless, the wire sensor will alternatively still function on the other side of corrugated cardboard sheeting 74 because of the dissolving or breakdown of sheeting 74 when the fluid from a breach in inner tank shell 12 reaches the region of the wire sensor.

Alternatively, enlarged head spaces 32 may be provided for larger types of sensors, either filled with open-cell foam as shown in FIG. 2 or provided with open spacing as shown in FIG. 18, in which case the one-sided corrugated cardboard will be wrapped primarily only about cylindrical inner tank body 14, and will advantageously have its grooves 88 oriented generally longitudinally of the tank, i.e., generally parallel to the cylindrical axis of the tank, for directly guiding the fluid from a breach in the inner tank shell cylindrical body to one or both head spaces 32, the fluid then flowing downwardly through one or both head spaces 32 to a sensor or sensors proximate the bottom of one or both head spaces 32.

Although the one-sided corrugated sheet material 74 of porous layer 18*c* is preferably corrugated cardboard, having a substantially neutral pH, because of its characteristic of dissolving or breaking down structurally when exposed to a fluid potentially to be sensed, it is to be understood that similarly configured one-sided sheeting 74 may be made of a material such as a resin material which does not have the characteristic of dissolving or otherwise breaking down structurally when exposed to a fluid potentially to be sensed. In such case, porous layer 18*c* is adapted for monitoring the integrity of inner tank shell 12, which is the matter of principal concern in monitoring spaces 30 and 32 between inner and outer tank shells 12 and 24, respectively.

With such a material for the one-sided corrugated sheeting 74, in a tank having a monitor located proximate the bottom of the tank in one or both ends of the tank between inner and outer heads 16 and 28, respectively, it is preferred to orient corrugation grooves 88 generally longitudinally of the tank, i.e., generally parallel to the cylindrical axis of the tank, along the length of inner cylindrical body 14; and to orient corrugated grooves 88 generally vertically over inner end heads 16. This way, any fluid from a rupture at any point in inner cylindrical body 14 will freely flow longitudinally through corrugation grooves 88 along inner cylindrical body 14 to one or both of head spaces 32, and then downwardly through the vertical corrugation grooves adjacent one or both of inner heads 16 to the monitor or monitors. Any rupture proximate one of the inner heads 16 will be received directly in vertical corrugation grooves 88 which face that inner head 16, to flow directly downwardly to the monitor. Nevertheless, with any one-sided corrugated sheet material, fluid will also flow down around the inside of the corrugated sheet material past corrugation ridges 86, because ridges 86 are not bonded to inner tank shell 12.

If a wire sensor is used in connection with such corrugated sheeting 74, it is arranged between corrugated sheeting 74 and inner tank shell 12, preferably extending from the top of tank 10 vertically down through one end of head space 32 to proximate the bottom of tank 10, and then longitudinally proximate the bottom of the tank along the length of the tank in cylindrical space 30.

With the one-sided corrugated sheeting made of cardboard or other material which will dissolve or otherwise break down structurally when exposed to a fluid potentially to be sensed, a breach in either inner tank shell 12 or outer tank shell 24 may be sensed. Fluid from a breach in inner tank shell 12 will flow directly into the open channels provided by grooves 88 and will flow through grooves 88, and also past ridges 86, to one or more sensors, while at the same time dissolving or breaking down the corrugated cardboard. On the other hand, fluid entering cylindrical space 30 or head spaces 32 through a breach in outer tank shell 24 will soak into and dissolve or break down the flat lamination 76 of corrugated sheet material 74 and get into grooves 89 between flat lamination 76 and corrugated lamination 82 and then break down corrugated lamination 82 and channel its way to one or more monitors.

FIGS. 14 and 15 illustrate an alternative tank construction wherein one or more monitor pipe struts extend substantially vertically, diametrically through the inner tank shell from the top of the tank down to the wall of the inner tank shell at the bottom of the tank, being exposed to the space between the inner and outer tank shells through one or more holes through the bottom of the inner tank shell. Such monitor pipe struts not only provide monitoring access to the cylindrical space in the bottom of the tank, but also add greatly to the beam strength of the tank. Applicant's monitor pipe struts are also embodied in the forms of the invention illustrated in FIGS. 19–32, and are specifically shown in FIGS. 28 and 32. The monitor pipe struts and their new and beneficial results will be further discussed in detail in connection with FIGS. 28 and 30.

An alternative tank of such construction shown in FIGS. 14 and 15 is generally designated 90, and includes inner tank shell 92 having a cylindrical body 94 and a pair of end heads 96; barrier layer 98 including cylindrical portion 99 and end portions 100; and outer tank shell 101 having a cylindrical body 102 and end heads 103. Inner tank shell 92 may be fabricated of steel or fiber-reinforced resin. Intermediate barrier layer 98 may be any barrier material shown and described herein, but is shown here made of one-sided corrugated sheet material 74, which is preferably one-sided corrugated cardboard having a substantially neutral pH. Outer shell 101 is fiber-reinforced resin applied over porous layer 98.

A pair of substantially vertically oriented and diametrically located monitor pipe struts 104 and 105 extend down through the inside of tank 90. These monitor pipe struts 104 and 105 are preferably regularly spaced along the length of tank 90; i.e., spaced approximately equidistant from the ends of tank 90 and from each other, so that structurally tank 90 is, in effect, made of three sections of approximately equal length, a pair of end sections 106 and 107, and a middle section 108. Monitor pipe struts 104 and 105 may be of any desired diameter and wall thickness. By way of example only, and not of limitation, suitable piping for monitor pipe struts 104 and 105, both for structural stiffening purposes and for adequate space for most types of monitors, is regular 2-inch ID steel pipe such as National Pipe Schedule 40.

Each of the monitor pipe struts 104 and 105 extends down to the inner surface of inner shell body 94, being bonded and sealed to inner shell body 94 by an annular weld 110 if inner shell 92 is made of steel, or by a resin bond 110 if the inner tank shell is made of fiber-reinforced resin. A small hole 112 through inner shell body 94 provides communication between the lower end of each monitor pipe 104 and 105 and the cylindrical space 113 between inner and outer cylindrical shell bodies 94 and 102, respectively. Each of the monitor pipe struts 104 and 105 extends upwardly through an aperture 114 in the top of inner shell body 94 and is attached to a threaded flange 116 which is threaded to receive a suitable monitor fitting. Such attachment is by an annular weld 118 if inner shell 92 is made of steel, or by a resin bond 118 if the inner tank is made of fiber-reinforced resin. Flange 116 is, in turn, bonded and sealed to the outside of inner shell body 94 by an annular weld 120 if inner tank shell 92 is made of steel, or a resin bond 120 if the inner tank shell 92 is made of fiber-reinforced resin. Flange 116 has a collar portion 121 which is internally threaded and extends upwardly through cylindrical portion 99 of porous layer 98 and cylindrical body 102 of outer shell 101, being bonded and sealed to outer shell body 102 by an annular resin bond 122. With this construction, monitor pipe struts 104 and 105 are completely isolated from the interior of inner tank shell 92, yet provide free access for lowering monitors 124 through monitor pipe struts 104 and 105 on monitor cables 126 for location of monitor sensors 124 proximate holes 112 and hence in communication with cylindrical space 113 at the bottom of tank 90.

The substantially equally spaced locations of monitor pipe struts 104 and 105 and their respective monitor sensors 124 along the length of tank 90 have two important benefits. First, such spacing provides optimum sensing locations for leakage into cylindrical space 113 from a breach at any location along the length of tank 90, since these are the sensing locations for minimum longitudinal flow of fluid from a breach, on the average. Second, monitor pipe struts 104 and 105 at these substantially uniformly spaced locations along the length of tank 90 provide an optimum amount of added beam stiffness to tank 90; i.e., stiffness against beam collapse. With conventional cylindrical tanks, the vulnerability of a tank to beam collapse increases with the length of the tank, so the added beam structural stiffness provided by monitor pipe struts 104 and 105 becomes very important with long tanks, which may be as long as 60 feet. For beam strength, the presence of the pair of monitor pipe struts 104 and 105 has effectively changed the length L of tank 90 to L/3.

Monitor pipe struts 104 and 105 stiffen tank 90 against both implosion and buckling. Implosion, or inward collapse, may be from any direction around the tank cylinder. The two monitor pipe struts 104 and 105 provide direct vertical support against vertical collapse, and they also stiffen tank 90 against horizontal collapse in the general direction of the phantom horizontal belt line 127 seen in FIG. 15, or collapse in other directions. Such other-than-vertical collapses require compensating vertical expansion of the tank, and monitor pipe struts 104 and 105 prevent such vertical expansion by their attachments to the top and bottom of inner tank shell 92, which is the primary structural basis for tank 90.

Although two substantially regularly spaced vertical monitor pipe struts have been shown in FIG. 14, it is to be understood that any number of such substantially regularly spaced vertical monitor pipe struts may be employed within the scope of the invention. Two such monitor pipe struts are generally adequate for most cylindrical underground tanks, but one may suffice for relatively short tanks. More than two such monitor pipe struts may be desirable in relatively long tanks if either added sensing coverage or increased tank beam strength is desired.

Applicant's testing has indicated that optimum tank beam strength is obtainable by having the individual beam length sections of the tank not more than about 10 feet long. Assuming optimum beam strength to be achieved at beam lengths of about 10, if a tank is 20 feet long, then a single monitor pipe strut proximate the center of the length of the tank will normally be satisfactory. A tank below 20 feet in length should have a monitor pipe strut generally centrally located along the length of the tank to perform the monitoring function, as well as strengthen the tank. Tanks over 20 feet in length up to 30 feet in length should have two generally regularly spaced monitor pipe struts along the length of the tank. Tanks over 30 feet in length should have monitor pipe struts at least about every ten feet between the end heads along the length of the tank.

Figure 16:
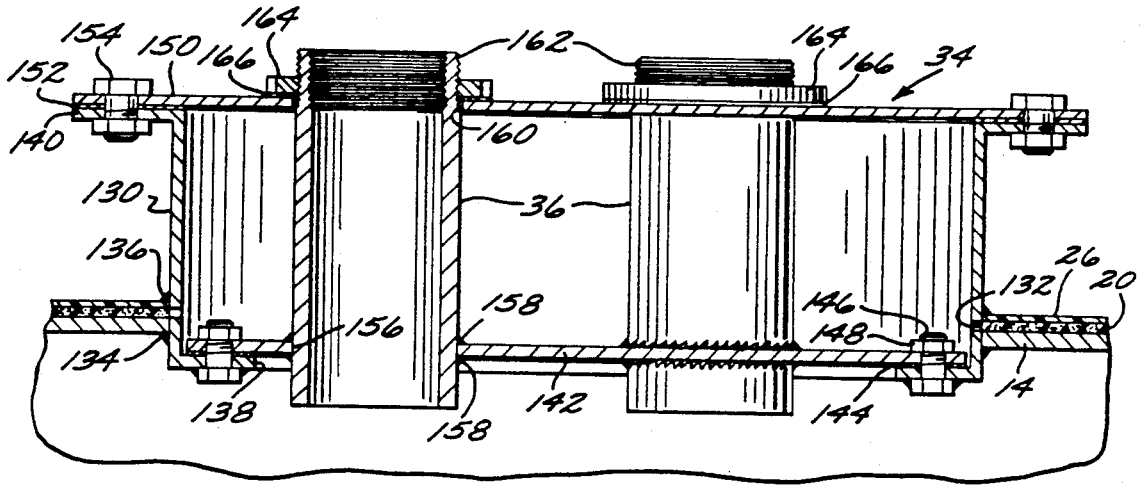
FIG. 16 is a fragmentary axial, vertical section taken on the line 16—16 of FIG. 1, illustrating the construction and mounting of a double wall manway forming a part of the tank shown in FIG. 1.

FIG. 16 illustrates the construction and mounting of double wall manway 34. Several forms of suitable double wall manways are disclosed in applicant's aforesaid U.S. Pat. No. 4,685,585. The double wall manway 34 shown in FIG. 16 of the present application is the form shown in FIGS. 9 and 10 of such patent. Manway 34 has three pipe fittings 36 extending therethrough, which, together with pipe fittings 38 provide the five pipe fittings normally required for underground fuel storage tanks. Two of the three fittings 36 are seen in the vertical sectional view of FIG. 16.

The primary basis for double wall manway 34 is a cylindrical riser 130 which is mounted in a circular aperture 132 that extends through all three layers of the tank sandwich, including cylindrical body 14 of inner tank shell 12, cylindrical portion 20 of intermediate porous layer 18, and cylindrical body 26 of outer tank shell 24. Inside the tank, riser 130 is bonded and sealed to inner tank body 14 by a generally annular inner bond 134; and outside the tank, riser 130 is bonded and sealed to the outer cylindrical body by a generally annular outer bond 136. Riser 130 may be installed in inner tank body 14 prior to application of the two outer layers of the tank sandwich, in which case inner bond 134 may be welding. If riser 130 is installed after the tank sandwich has been completed, then inner bond 134 will be a resin bond. Outer bond 136 is a resin bond.

Manway riser 130 has an in-turned inner annular flange 138 at its bottom, located within inner tank body 14, and an out-turned outer annular flange 140 at its top. An inner cover disk 142 seats on inner flange 138, with a sealing gasket 144 therebetween. An annular array of regularly spaced studs 146 extends upwardly from inner flange 138 through registering holes in inner cover disk 142, and nuts 148 threaded onto studs 146 clamp inner cover disk 142 against gasket 144.

An outer cover disk 150 seats against outer flange 140 with a sealing gasket 152 therebetween, and outer cover disk 150 is clamped against gasket 152 by an annular array of regularly spaced bolts 154.

The three pipe fittings 36 are mounted in three respective apertures 156 through inner cover disk 142, being bonded and sealed thereto by welds 158. Fittings 36 extend upwardly through apertures 160 in outer cover disk 150. Pipe fittings 36 each have an externally threaded upper end section which receives a large nut 164 adapted to clamp down against outer cover disk 150, with a sealing gasket 166 therebetween.

Figure 17:
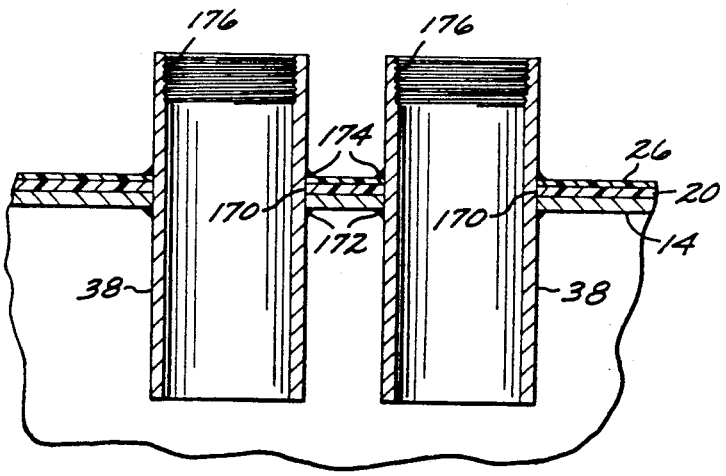
FIG. 17 is a fragmentary axial, vertical section taken on the line 17—17 in FIG. 1, illustrating the construction and mounting of pipe fittings embodied in the tank shown in FIG. 1.

FIG. 17 shows details of the structure and mounting of pipe fittings 38. A circular aperture 170 is provided through all three layers of the tank sandwich at the top of the cylindrical part of tank 10. Thus, aperture 170 extends through inner cylindrical body 14 of inner tank shell 12, cylindrical portion 20 of intermediate barrier layer 18, and cylindrical body 26 of outer tank shell 24. Inside tank 10, each of the pipe fittings 34 is bonded and sealed to inner shell body 14 by means of an inner annular bond 172; and outside tank 10, each of the fittings 34 is bonded and sealed to outer shell body 26 by means of an outer annular bond 174. Pipe fittings 34 may be installed in inner shell body 14 prior to application of the intermediate barrier layer portion 20 and outer shell body, in which case the inner bonds 172 will normally be welds. If such is the case, then the outer two layers 20 and 26 will be applied around fittings 38. However, apertures 122 may be cut through all three layers after the layers have been assembled, and fittings 38 then installed, in which case inner bonds 172 will be resin bonds so that welding temperatures will not disturb the integrity of intermediate barrier layer 20 and outer body layer 26. Outer bond 174 is a resin bond. Pipe fittings 34 each have an internally threaded outer end section 176 for connection to function pipes.

FIG. 18 shows another form of the invention, generally designated 180, which employs separate head members as parts of the outer tank shell, with generally unfilled space between the inner and outer shell heads. This alternative double wall tank 180 has an inner tank shell 182 like inner tank shell 12 of the previously described forms of the invention, including a cylindrical inner body 184 which is closed at both ends with inner heads 186.

The separate shell head members are generally designated 188, and are the same for both ends of the tank, only one of them being illustrated. Outer shell head member 188 is preferably made of steel, but if desired, may be made of other material, such as fiber-reinforced resin. Outer head member 188 has a peripheral flange 190 that is bonded and sealed around its edge to the periphery of inner shell body 184 by annular bond 192 which is a weld for a steel head member 188 and a resin bond for a fiber-reinforced head member 188, leaving generally open head space 194 between the two heads 186 and 188. Outer head flange 190 has a series of regularly spaced holes annularly arranged about it.

The cylindrical intermediate barrier layer 198 corresponding to the portion 20 of intermediate barrier layer 18 in the forms of the invention shown in FIGS. 1–4, or layers 18*a*, 18*b* or 18*c* of the other forms of the invention shown in FIGS. 5–15, extends cylindrically beyond head 96 of inner cylindrical body 94 to overlap peripheral flange 190 of outer head member 188.

The fiber-reinforced outer shell 200 is applied over cylindrical intermediate barrier layer 198, and over the outside of outer tank shell head member 188, outer shell 200 therefore including a cylindrical body portion 202 and a head portion 204. A fluid-sensing monitor sensor may be provided proximate the bottom of tank 180 within head space 102 at one or both ends of tank 180. A monitor pipe 206 extends from the top of outer head flange 190 down through head space 194 to proximate the bottom of space 194. Pipe 206 is attached at its upper end to a monitor fitting 208 on flange 190, and a monitor sensor is lowered on its cable down through fitting 208 and pipe 206 to proximate the bottom of head space 194.

The separate end head members 188 facilitate filament winding of outer shell 200 of tank 180 by providing desired extra strength at the ends of tank 180 without need for filament winding over the ends. This then simplifies the filament winding process by enabling it to be limited to the cylindrical portion 112 of outer shell 200 where conventional cylindrical filament winding procedures and equipment may be employed.

It will be seen that any liquid or gas flowing into cylindrical barrier layer 198 from a breach in either inner tank shell 182 or outer tank shell 200 will flow through one or more of the flange holes 196 into head space 194 to be sensed by the monitor sensor therein; and any direct flow of liquid or gas into head space 194 from a breach in either of the inner or outer head members will flow downwardly through head space 194 to be sensed by the monitor sensor proximate the bottom thereof.

Double Wall Tank Form of FIGS. 19-32

FIGS. 19-32 illustrate the manufacturing procedures and construction of presently preferred double wall tanks according to the invention wherein a novel intermediate barrier layer composed of metal foil, preferably aluminum foil, surprisingly and synergistically serves five functions which cooperate to provide a particularly lightweight, inexpensive and durable double wall tank. According to these forms of the invention, the inner primary containment tank shell is preferably made of steel, the outer secondary containment tank shell is preferably made of fiber-reinforced resin, and the intermediate barrier layer is made of overlapping aluminum foil sheeting.

The five functions which the aluminum foil barrier layer serves are: (1) during fabrication of the double wall tank, the overlapping aluminum foil sheeting serves as a resin barrier to prevent resin from bonding to the primary inner shell, and thereby preserves the integrity of the secondary containment space and area between the two shells; (2) the aluminum foil sheeting provides secondary containment space and area for capturing any fluid escaping outwardly through a breach in the inner primary containment tank shell or inwardly through a breach in the outer secondary containment tank shell, and provides flow space and area for conducting any such fluid to one or more fluid monitors; (3) the overlapping aluminum foil sheeting provides a vapor barrier surrounding the inner primary containment tank which is essentially impervious to hydrocarbon vapors, thereby enabling a substantial reduction of the thickness, and hence cost, of the outer secondary containment tank shell; (4) the aluminum foil sheeting provides electrochemical protection for the inner steel shell against corrosion in the event of a breach in the outer resin shell; and (5) the aluminum foil sheeting intermediate barrier layer minimizes secondary containment space, which increases monitoring sensitivity.

FIGS. 19-27 illustrate a series of manufacturing steps which may be followed for the efficient manufacture of a double wall cylindrical tank embodying the aluminum foil intermediate barrier layer of this form of the invention. The manufacturing steps illustrated in FIGS. 19-27 produce a completely fabricated double wall tank which may be considered to be a "blank" tank in that the inner and outer tank shells and the intermediate barrier layer are each continuous over the entire body of the tank, and none of the manways or function pipe fittings have yet been installed. These are installed after the tank blank has been completely fabricated. This allows first the intermediate barrier layer and then the outer secondary containment tank layer to be applied over the inner primary tank shell by simply rotating the inner tank shell on shafts which are coaxial with its cylindrical axis, and winding first the aluminum foil sheeting and then fiber cloth or matting soaked with resin helically onto the rotating cylindrical barrel of the inner tank shell, without having to give detailed attention to the various manways and function pipe fittings during application of the two outer layers. Also, there are no protuberances to snag or get caught during establishment of the secondary containment zone and application of the outer secondary containment shell, which is a problem with the usual procedure of installing the manways and pipe fittings before dealing with the secondary containment space and outer shell. The heads of the inner tank shell may be covered with the resin-soaked fiber cloth or matting either before or after the intermediate and outer layers are wound onto the barrel, preferably after.

An important advantage of preparing the double wall tanks of the invention in blank form is that factory tank inventory can then be in blank form suitable for any desired end use, and then fixtures such as manways and function pipe fittings may be installed upon customer order. This greatly reduces factory inventory by eliminating a multitude of inventory tanks having a variety of specialized fixtures.

Figure 19:
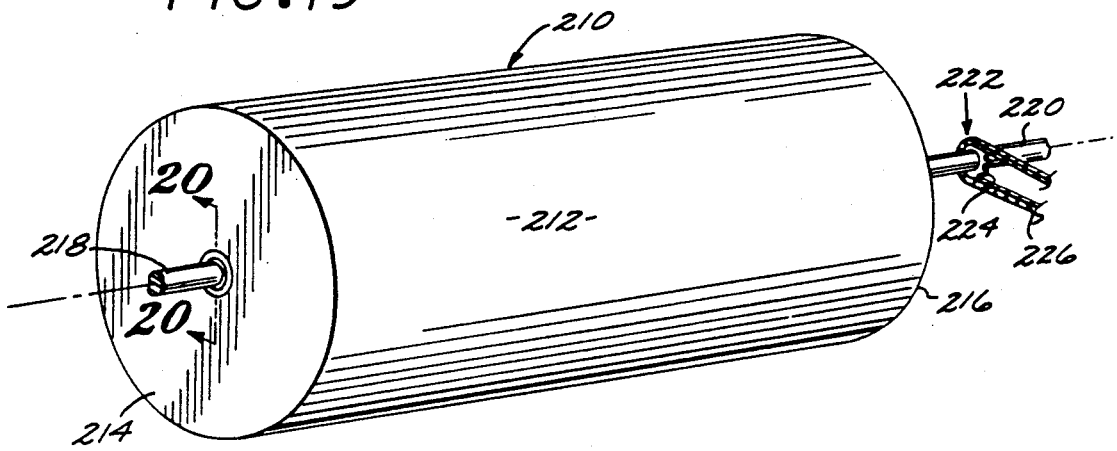
FIG. 19 is a perspective view of a cylindrical steel inner primary containment tank shell having removable, coaxial rotational support shafts protruding from the end heads, and a drive unit associated with one of these shafts for winding intermediate and outer layers onto the inner tank shell.

Referring at first to FIG. 19, the inner primary containment tank shell is generally designated 210, and is preferably made of mild steel, but may alternatively be made of fiber-reinforced resin. Inner tank shell 210 has a right circular cylindrical body 212, and a pair of end heads 214 and 216. Stub shafts 218 and 220 are removably secured to respective end heads 214 and 216, and are coaxial with the axis of inner tank shell cylindrical body 212. Shafts 218 and 220 are supported for rotation in respective trunions or bearings in large lathe-like apparatus, with shafts 218 and 220 and cylindrical body 212 supported horizontally. A rotary drive unit generally designated 222 is shown associated with shaft 220, and includes a sprocket 224 fixedly secured to shaft 220 and a drive chain 226 engaged over sprocket 224 and driven by suitable power drive apparatus (not shown).

Figure 20:
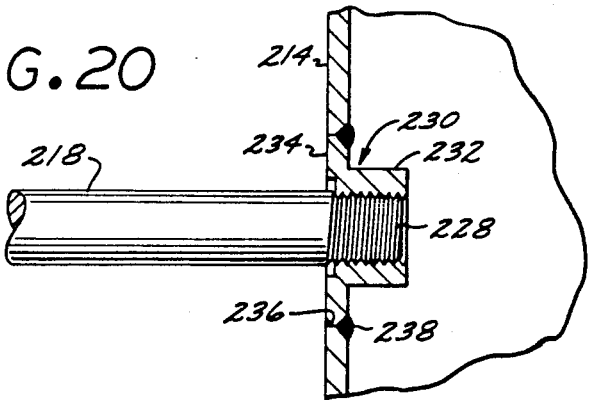
FIG. 20 is an enlarged, fragmentary axial section, partly in elevation, illustrating the removable mounting of one of the axial support shafts.

FIG. 20 illustrates, in connection with shaft 218, a presently preferred mounting for each of shafts 218 and 220 which enables the shafts to be removed from the tank heads after completion of the double wall tank blank. Shaft 218 is provided with a threaded end 228 which is threadedly engaged in a support fitting generally designated 230 that is permanently secured in the radial center of head 214. Support fitting 230 consists of an internally threaded annular collar 232 which is integral with a generally flat, circular flange 234. A circular hole 236 is cut in the center of tank head 214, and flange 234 is welded in position within hole 236 so that the outer surface of flange 234 is flush with the outer surface of end head 214 by means of an internal annular weld 238. Support fittings 230 are thus installed in tank heads 214 and 216 before heads 214 and 216 are affixed in the ends of cylindrical body 212.

Figure 24:
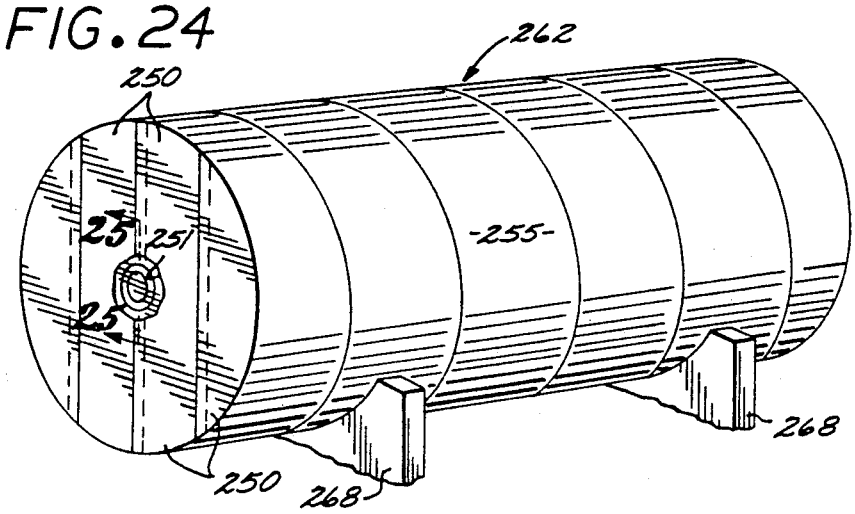
FIG. 24 is a view similar to FIG. 23, but with the cylindrical barrel of the inner tank structure and aluminum foil covering fully covered by the helically wound resin-impregnated fiberglass sheeting, the resin being hardened, the inner tank structure being set onto suitable supports, and the rotary support shafts removed from the end heads of the inner tank structure.
Figure 26:
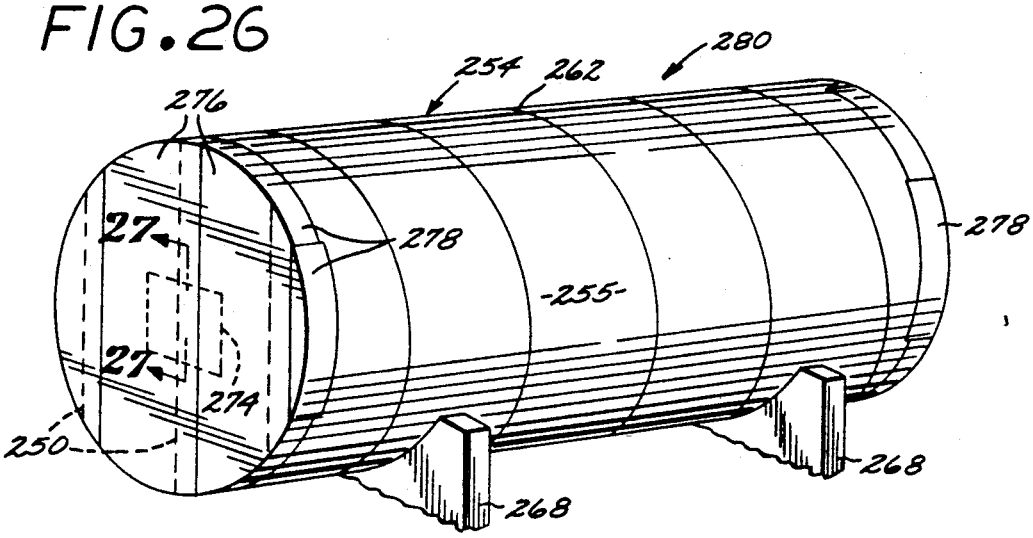
FIG. 26 is a view similar to FIG. 24, with aluminum foil patching over the plugged shaft support structure, and resin-impregnated overlapping fiberglass sheets over the end head aluminum sheeting and patching, with cylindrical portions of these end sheets overlapping end portions of the overlapping helical resin-impregnated fiberglass sheeting.
Figure 25:
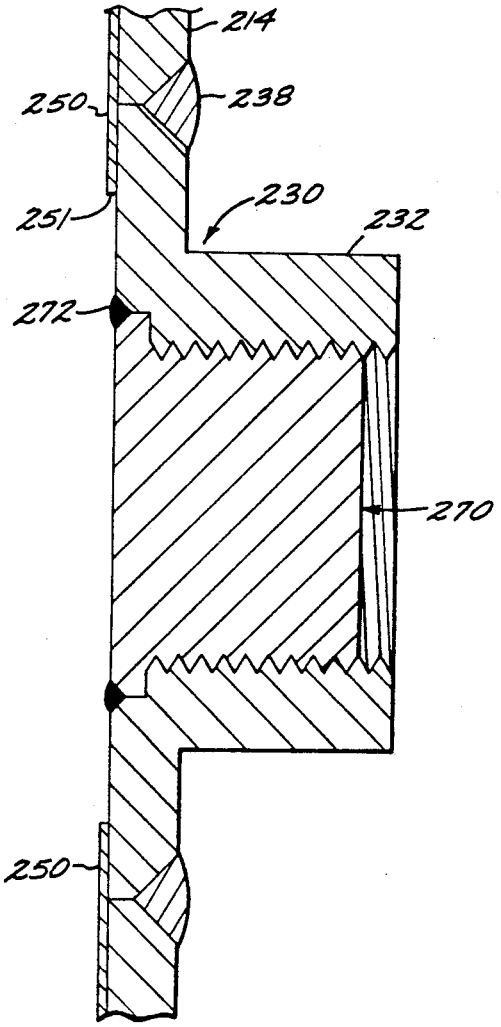
FIG. 25 is a greatly enlarged, fragmentary axial sectional view taken on the line 25—25 in FIG. 24, illustrating a plug fitted and secured into the support fitting for the removed shaft on one end head of the inner tank structure.
Figure 27:
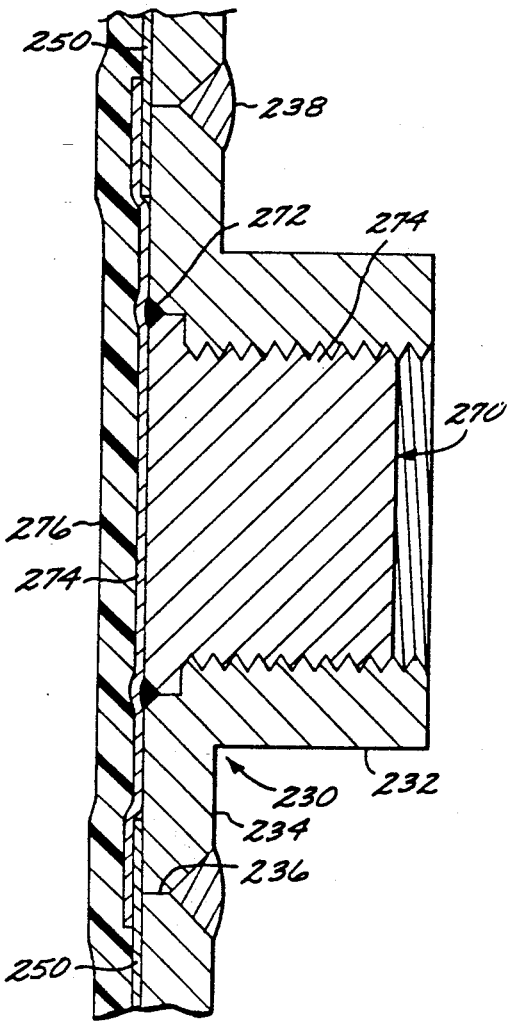
FIG. 27 is an enlarged, fragmentary axial sectional view similar to FIG. 25, illustrating both the aluminum foil patching and the resin-impregated fiberglass end sheeting.

To prepare inner tank shell 210 for its rotatable mounting, shafts 218 and 220 are simply threadedly engaged in threaded fitting collars 232 in respective heads 214 and 216, and the tank hoisted onto the trunions or bearings and drive unit 222 engaged for operation. After the complete tank blank has been fabricated, the tank is lifted out of the trunions or bearings and set onto a suitable fixed support structure, as illustrated in FIGS. 24 and 26, shafts 218 and 220 unthreaded from collars 232, and permanent plugs engaged in collars 232 as illustrated in FIGS. 25 and 27.

Figure 21:
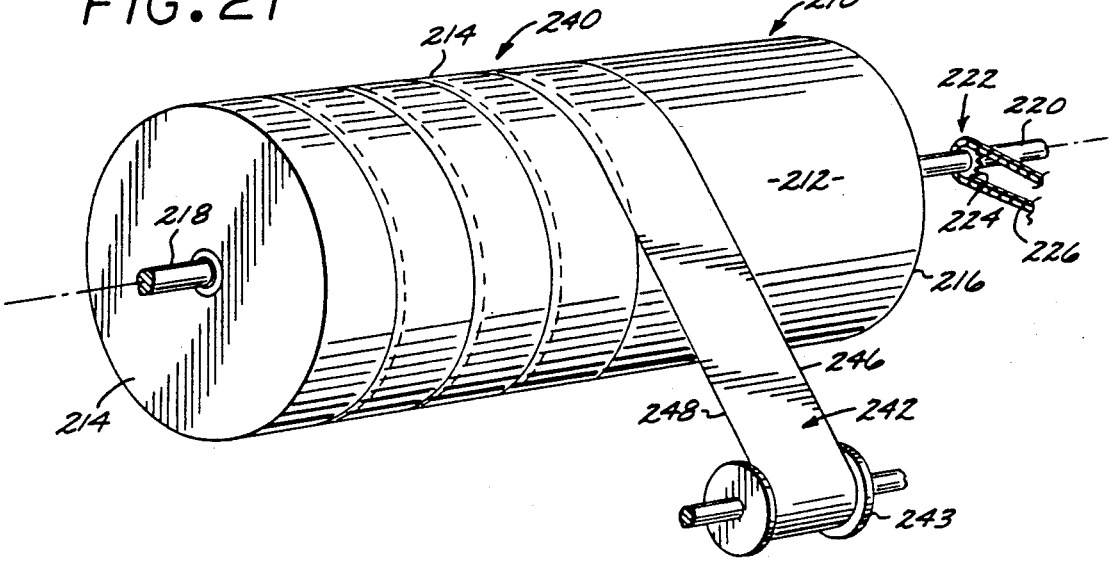
FIG. 21 is a perspective view similar to FIG. 19, with an elongated sheet of aluminum foil being helically wound in overlapping coils onto the inner cylindrical primary containment tank body off of a supply spool or spindle.
Figure 22:
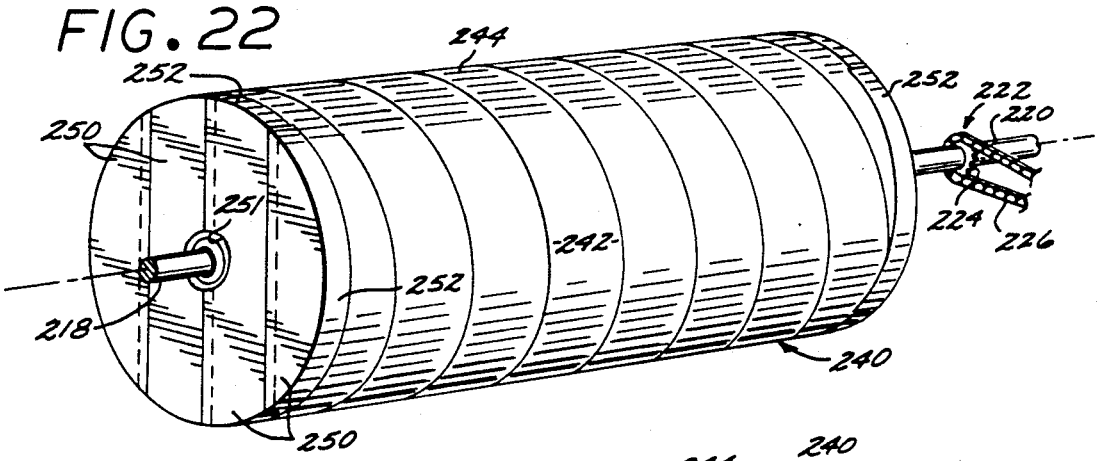
FIG. 22 is view similar to FIG. 21, with the overlapping helical aluminum foil winding completely covering the cylindrical barrel of the inner tank body, and overlapping end strips of aluminum foil sheeting covering the end heads of the inner tank structure and overlapping end portions of the helical cylindrical aluminum foil covering.

FIGS. 21 and 22 illustrate establishment of the cylindrical portion of intermediate barrier layer 240 by the convenient procedure of helically winding a continuous, elongated sheet 242 of aluminum foil onto cylindrical body 212 of inner tank shell 210. The elongated aluminum sheeting 242 is supplied from a rotatable spool or spindle 243. The aluminum foil sheeting may be of any desired thickness, as for example, from about 0.5 mils to about 3 mils, and may have any desired state of temper, provided it is not so brittle as to tend to crack. An example of aluminum foil which has been found suitable in testing is heavy duty kitchen foil which is about 3 mils thick. This is an 1100 series aluminum alloy having temper 0. The temper 0 is preferred for the present purpose because harder tempers require a heat-/oil quench rolling procedure which leaves a film of oil on one side of the finished foil. It is preferred not to have such an oil residue on the foil for two reasons. First, without the oil residue, the resin of the outer secondary containment tank shell will generally seal the overlap junctures of the aluminum foil, and such sealing improves the effectiveness of the foil as an excellent vapor barrier against escape of hydrocarbon vapors, and this in turn enables the resin outer tank shell to be made thinner and hence less costly and lighter. Second, the presence of oil in the secondary containment zone defined by the foil could possibly confuse hydrocarbon-sensitive monitor sensors employed with the invention.

Figure 31:
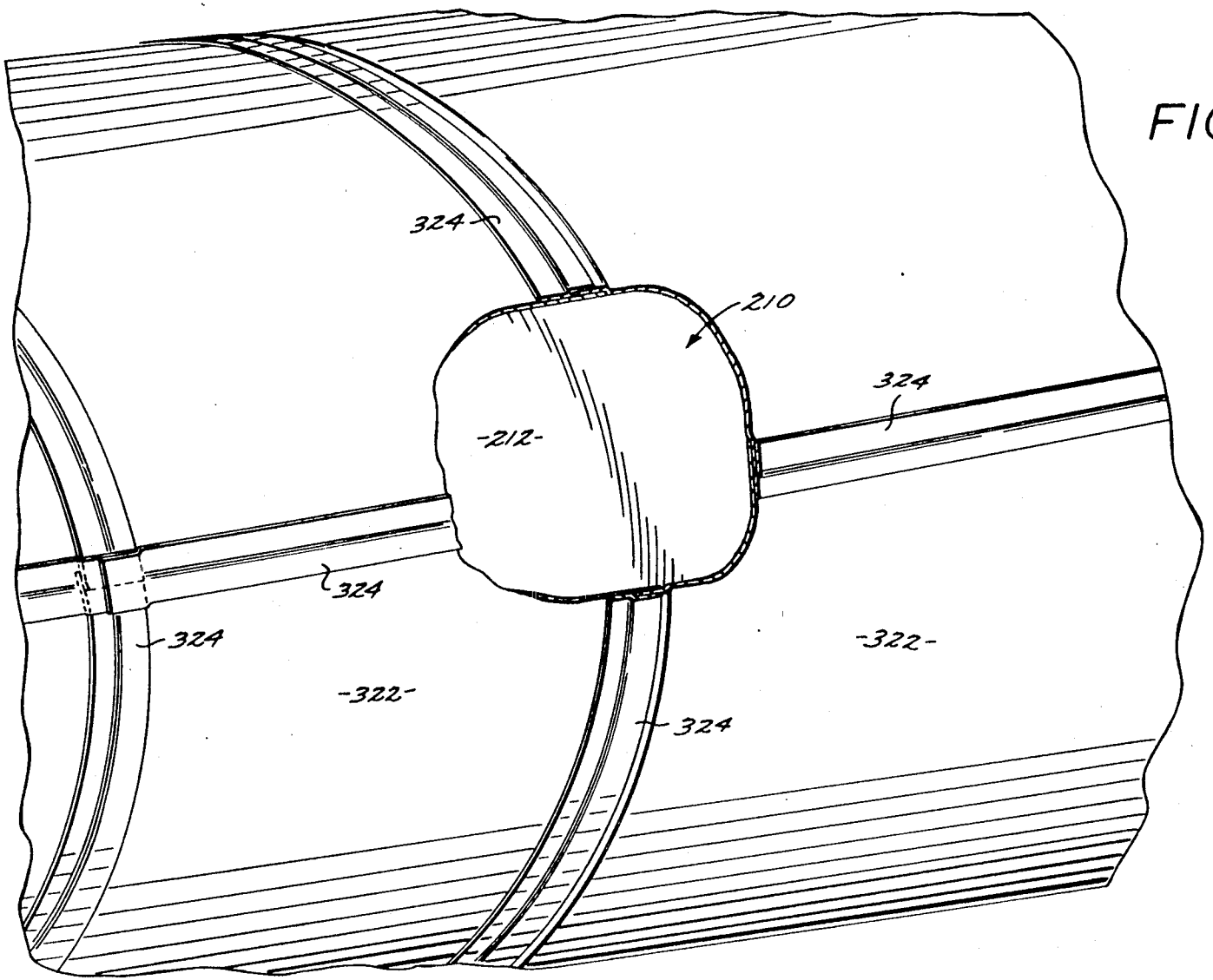
FIG. 31 is a perspective view, with portions broken away, illustrating a completed double wall tank according to the invention, which is similar to the tank shown in FIGS. 28-30, but has the aluminum foil barrier layer deployed in overlapping annular hoops sealed at the overlaps with adhesive aluminum foil tape.

A positive seal of the aluminum foil junctures is preferably assured by covering them with aluminum foil adhesive tape, as illustrated in FIG. 31 and described in detail hereinafter.

The free end of foil sheeting 242 off of spool 243 is taped or otherwise tacked to one end of inner tank cylindrical body 212, in the case of FIGS. 21 and 22 the left-hand end as viewed, and foil sheeting 242 is wound onto cylindrical body 212 by rotation of body 212. During this procedure spool 243 is shifted longitudinally generally parallel to the axis of body 212 so as to produce the overlapping helical configuration 244 of intermediate barrier layer 240. During this winding operation, as leading side edge 246 of foil sheeting 242 progresses along the uncovered surface of body 212, trailing side edge 248 of foil sheeting 242 overlaps leading edge 246 of the preceding coil. The amount of overlap is not important, so long as sufficient overlap is provided to assure that intermediate barrier layer 240 is fully continuous over the entire length and circumference of cylindrical body 212. When cylindrical body 212 has been completely covered by foil 242, the end of the foil is cut from that remaining on spool 243 and taped or otherwise tacked to tank shell 210. Then the ends of foil sheeting 242 are trimmed off at tank heads 214 and 216.

Next, end strips 250 of foil sheeting 242 are otherwise taped or tacked over end heads 214 and 216 of inner tank shell 210, these end strips 250 overlapping each other in the same manner as the overlapping helical winding configuration 244. A central aperture 251 is cut in overlapping end strips 250 over each end head 214 and 216 to accommodate support shafts 218 and 220. End strips 250 extend circumferentially beyond the peripheries of heads 214 and 216 and are folded over the end portions of the helical winding 244 so as to provide cylindrical overlap portions 252 of end strips 250. As an alternative to this sequence of application of the aluminum foil, end strips 250 and their overlap portions 252 could be applied before the helical winding 244 so that the ends of helical winding 244 would then overlap cylindrical portions 252 of end strips 250. Thus, the entire inner primary containment tank shell 210 is covered by overlapping aluminum foil, except at the centers of the ends where support shafts 218 and 220 project from end heads 214 and 216.

Although it is economical and convenient to helically roll the elongated aluminum foil sheeting 242 onto cylindrical body 212 of inner tank shell 210, it is to be understood that foil sheeting 242 may be otherwise layed onto cylindrical body 212, as for example in circularly oriented overlapping hoops, or in longitudinal overlapping strips generally parallel to the longitudinal axis of cylindrical body 212, or otherwise. A circular hoop form of the invention is illustrated in FIG. 31. Testing has indicated that orientation of elongated aluminum foil sheeting 242 on cylindrical body 212, or on end heads 214 and 216, relative to the vertical does not materially influence the performance of aluminum foil sheeting 242 as an integrated intermediate barrier layer 240. Elongated foil sheeting 242 may be of any desired width between its side edges 246 and 248, provided that it is not so narrow as to require a burdensome number of coils or hoops in intermediate barrier layer 240, and provided that the sheeting is not so wide as to become unmanageable. Widths of between about 3 and 4 feet are suitable.

Figure 23:
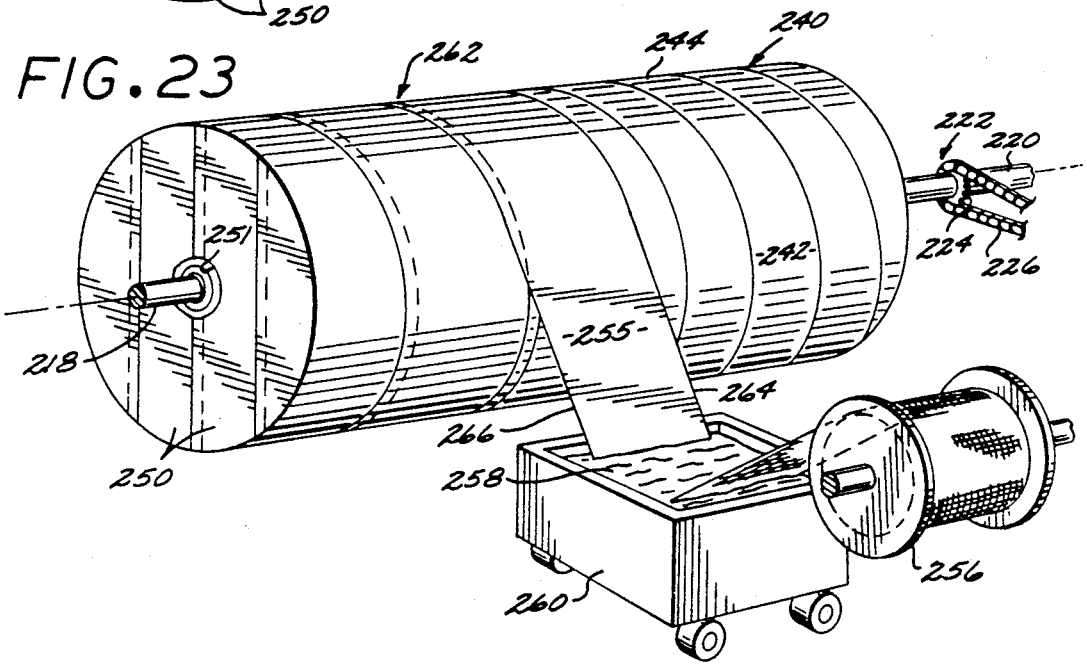
FIG. 23 is a view similar to FIG. 21, illustrating elongated fiberglass cloth or matting being supplied from a spool or spindle, then immersed in a resin bath, and then helically wound onto the cylindrical barrel of the inner primary containment tank structure over the aluminum foil covering.

FIG. 23 illustrates application of resin-impregnated fiber cloth or matting over aluminum foil intermediate barrier layer 240 to fabricate the cylindrical portion of outer secondary containment shell 254. As with the other forms of the invention previously described, the fiber cloth or matting may include such fibers as glass fibers, graphite fibers, Kevlar fibers, metal fibers, or other suitable strengthening fibers. Also, as with the previously described forms of the invention, the resin material with which the fiber cloth or matting is impregnated may be polyester, epoxy, polyurethane, or other suitable resin material. Fiberglass cloth or matting is preferred because it is economical and readily available.

The fiberglass cloth or matting is generally designated 255, and is in elongated sheet form supplied from a spool or spindle 256 which is movable generally parallel to the longitudinal axis of cylindrical body 212 of inner tank shell 210. After leaving spool 256 and before being wound onto cylindrical body 212, the fiberglass sheeting is passed through a resin bath 258 in a resin container 260 which is also movable generally parallel to the longitudinal axis of cylindrical body 212, generally synchronously with such axial movement of spool 256. Resin-soaked fiberglass sheeting 255 is applied helically in the same manner as aluminum foil sheeting 242 was applied, with both spool 256 and resin container 260 moving generally parallel to cylindrical body 212 at a rate that will cause each loop of the impregnated fiberglass sheeting 255 to continuously overlap the preceding loop thereof as illustrated in FIG. 23, with leading side edge 264 of sheeting 255 progressing over the already-established intermediate barrier layer 240, and trailing side edge 266 of fiberglass sheeting 255 continuously overlapping the preceding leading side edge 264. This procedure continues until the entire surface of the cylindrical portion of intermediate barrier layer 240 has been covered, at which time the applied fiberglass sheeting is cut from that which is coming from spool 256.

When the resin has hardened, overhanging edges of reinforced sheeting 255 are trimmed back to end heads 214 and 216 of tank shell 210. This may be done either when the tank is supported on shafts 218 and 220, or after it has been lowered onto suitable support structure such as supports 268 shown in FIG. 24. With the resin hardened, shafts 218 and 220 provide convenient handling means for lowering the tank onto support members 268 where it is now stationarily supported as shown in FIG. 24.

The next step in the fabricating procedure is to remove shafts 218 and 220 by unscrewing them from their respective support fittings 230; shafts 218 and 220 having been removed in FIG. 24.

Referring now to FIG. 25, after removal of shafts 218 and 220, threaded plugs 270 are threadedly engaged in respective support fittings 230 in tank end heads 214 and 216, the outer surfaces of plugs 270 aligning with the outer surfaces of support fittings 230 and end heads 214 and 216. Annular external welds 272 seal and secure plugs 270 in their respective fittings 230.

An aluminum foil patch 274 is then placed in covering relationship over aperture 251 in aluminum foil strips 250 at each end of the tank, in covering relationship over plugs 270, support fittings 230, and edge portions of aluminum foil end strips 250, patches 274 being taped or otherwise tacked into position.

Overlapping resin-impregnated fiberglass end sheets 276 are then placed in covering relationship over each of tank end heads 214 and 216 and aluminum foil patches 274. These overlapping end sheets 276 are somewhat larger than tank heads 214 and 216, and their edges are folded down over the ends of the cylindrical part of the fiberglass/resin tank covering to provide cylindrical overlap portions 278 which bond and seal relative to the cylindrical fiberglass/resin end portions. When end sheets 276 and their cylindrical overlap portions 278 cure, the blank tank, generally designated 280, is completely fabricated.

If desired, instead of helically winding resin-impregnated fiberglass cloth or matting 255 onto cylindrical body 212, the impregnated fiberglass sheeting 255 may be layed onto cylindrical body 212 in circular hoops, or longitudinally, or otherwise oriented, without diminishing the integrity of finished outer secondary containment shell 254. Also, if desired, outer secondary containment shell 254 may be made by spraying resin which contains chopped fibers over the outside of aluminum foil intermediate barrier layer 240. If the outer secondary containment shell is applied in this manner, the cylindrical part, and possibly peripheral portions of the end parts, will preferably be applied while inner tank shell 210 is still supported on axial shafts 218 and 220. Then when this fiber-reinforced resin has hardened, the tank will be set onto supports 268, shafts 218 and 220 removed, plugs 270 installed and welded into place, aluminum foil patches 274 placed into position, and foil-covered end heads 214 and 216 sprayed with fiber-containing resin to complete blank double wall tank 280.

Figure 28:
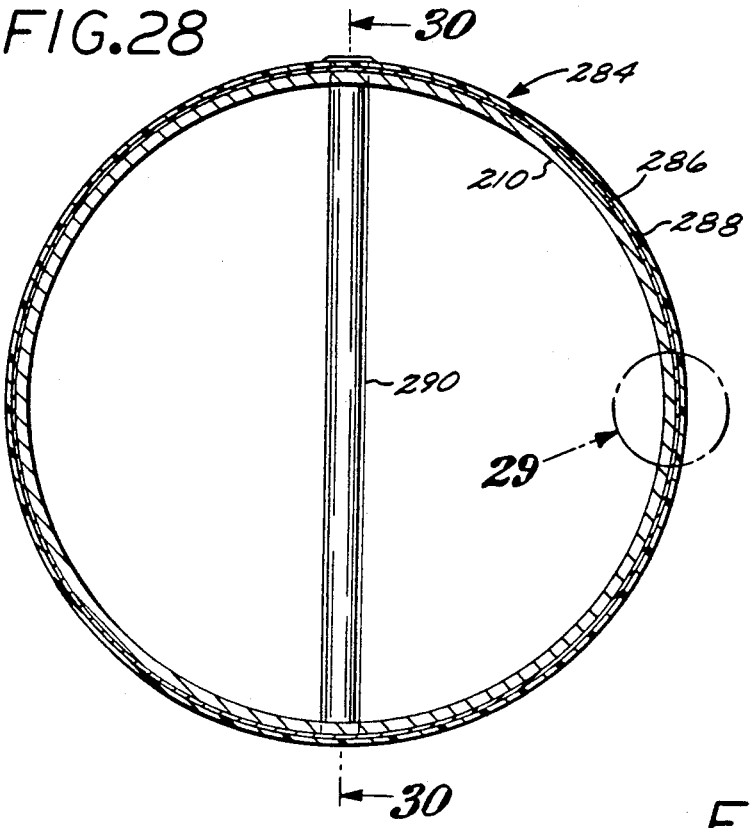
FIG. 28 is a transverse sectional view of a completed double wall tank fabricated pursuant to the procedures of FIGS. 19-27, and illustrating one of a plurality of vertically, diametrically oriented monitor pipe struts embodied in the completed tank for both fluid monitoring and tank strengthening.
Figure 29:
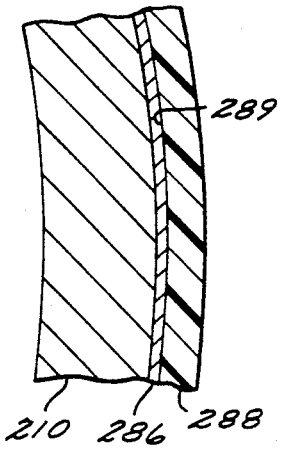
FIG. 29 is a greatly enlarged view of the encircled portion of FIG. 28 designated 29, illustrating the inner and outer tank shells, the intermediate aluminum foil barrier layer, and the interstitial space between the inner and outer tank walls generally defined by the aluminum foil barrier layer.
Figure 30:
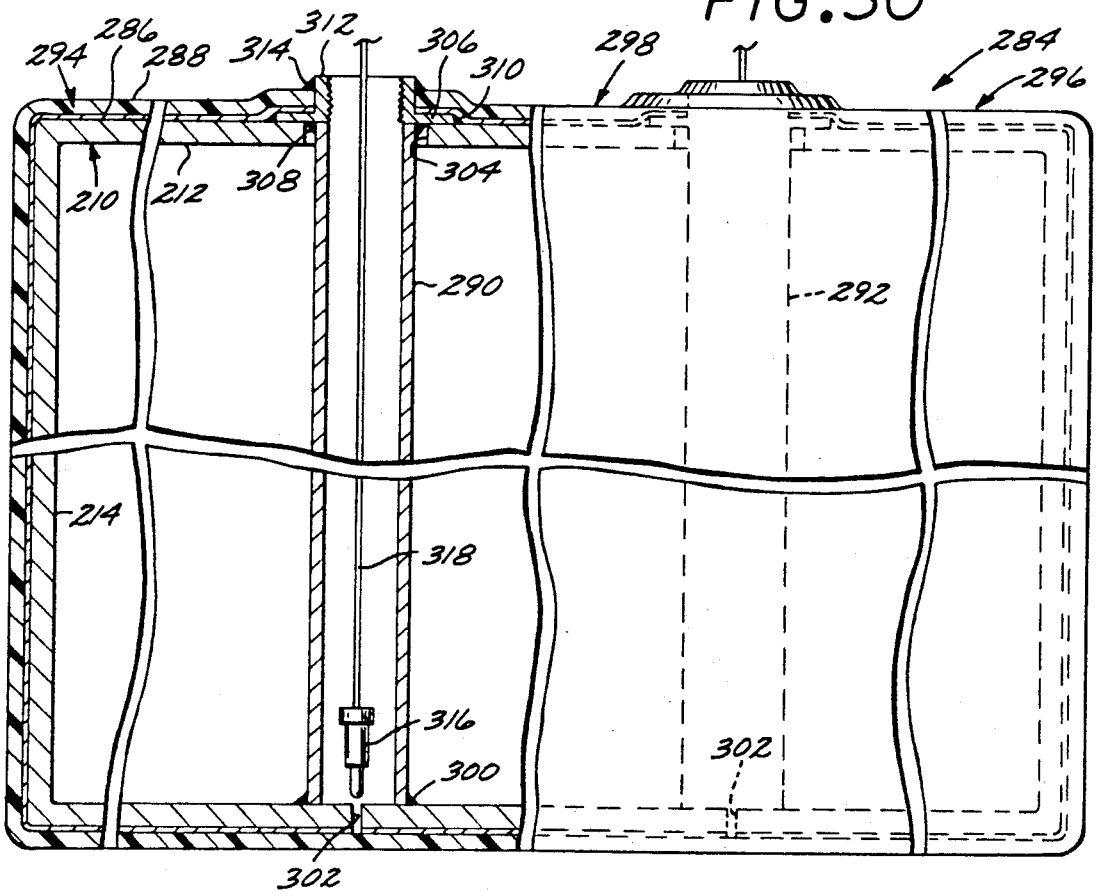
FIG. 30 is a view similar to FIG. 14 further illustrating the completed tank of FIGS. 28 and 29.

FIGS. 28–30 illustrate a completed double wall tank according to this form of the invention, generally designated 284, wherein tank blank 280 has been modified to include a pair of monitor pipe struts like those shown and described in connection with FIGS. 14 and 15. Completed tank 284 will also include at least one manway and a plurality of function pipe fittings which are not shown, but which will be installed similarly as the upper portions of the monitor pipe struts as described below.

Completed tank 284 includes inner primary containment tank shell 210, aluminum foil barrier layer 286, outer fiber-reinforced resin shell 288, and a pair of generally vertically oriented, longitudinally spaced monitor pipe struts 290 and 292. Interstitial space 289 is defined between respective inner and outer shells 210 and 288 by intermediate barrier layer 286. Monitor pipe struts 290 and 292 are preferably installed in inner primary containment tank shell 210 during its fabrication, as described hereinafter in connection with FIG. 32. The aluminum foil may then be wrapped around inner shell 210 in the manner shown in FIGS. 21 and 22, or in FIG. 31, and cut away as required for monitoring access.

Monitor pipe struts 290 and 292 not only enable monitoring at optimum locations in the bottom of double wall tank structure 284, but also maximize structural strength of tank 284, and enable a substantially thinner-walled inner tank shell 210, thereby reducing material costs and making handling easier.

Monitor pipe struts 290 and 292 are generally vertically oriented and diametrically located in inner primary containment tank shell 210, and are generally regularly spaced along the length of tank shell 210 in the manner described in connection with FIGS. 14 and 15. Thus, inner tank shell 210 is structurally, in effect, made of three sections of approximately equal length, a pair of end sections 294 and 296, and a middle section 298. Each of monitor pipe struts 290 and 292 extends down to the inside surface of inner tank cylindrical body 212, being bonded and sealed to cylindrical body 212 by an annular weld 300 if body 212 is made of steel, or by a resin bond 300 if body 212 is made of fiber-reinforced resin. The lower end of each monitor pipe strut 290 and 292 communicates through a hole 302 in cylindrical body 212 with the cylindrical space and area defined by intermediate barrier layer 286 between inner tank shell 210 and outer tank shell 254. Holes 302 continue through foil barrier layer 286 to provide monitoring access to interstitial space 289 on both sides of foil barrier layer 286. Each of monitor pipe struts 290 and 292 extends upwardly through an aperture 304 in the top of cylindrical body 212, and terminates proximate the upper surface of body 212. The upper end of each monitor pipe strut 290 and 292 is attached to a monitor fitting flange 306 by means of an annular weld 308, flanges 306 in turn being attached and sealed to the upper surface of inner tank cylindrical body 212 by annular peripheral welds 310. Flanges 306 have internally threaded, upwardly extending collar portions 312 adapted to receive monitor sensor fitting connections. If inner tank shell 210 is fiber-reinforced resin rather than steel, seals 308 and 310 will be resin seals rather than welds.

Welds (or resin bonds) 300, monitor pipe struts 290 and 292, flanges 306, and welds (or resin bonds) 308 and 310 provide continuation for the primary containment function of inner tank shell 210.

After application of the fiber-reinforced outer resin shell 288 over foil barrier layer 286, with shell 288 suitably cut away around flange collar portions 312, external annular resin seals 314 are applied between resin shell 288 and flange collar portions 312.

Monitor sensors 316 are lowered on monitor cables 318 through each of the monitor pipe struts 290 and 292 so that sensors 316 are proximate monitoring holes 302 through the bottom of inner tank shell 210 and foil barrier layer 286.

Intermediate barrier layer 286 may comprise any metallic substance that is higher on the electromotive force series of elements, or galvanic series, than iron which is the principal component of a steel inner tank shell 210. Aluminum foil is the preferred metallic substance since it is substantially higher than iron on the electromotive series, aluminum having an electrode potential of 1.70 and iron having an electrode potential of 0.441. Aluminum foil is also economical and readily available, and is convenient to manipulate. It has other advantages discussed below relative to the five functions set forth in the first paragraph of this section of the Detailed Description relating to FIGS. 19–32.

Other metallic elements which might be employed in the intermediate barrier layer 286 are chromium (electrode potential of 0.557), zinc (electrode potential 0.762), beryllium (electrode potential 1.69), and magnesium (electrode potential 2.40). It is believed that any of these additional metallic elements that are higher in the electromotive series than iron may be provided in elongated foil sheet form so as to be applicable to inner tank shell 210 in the manner described above in connection with FIGS. 21 and 22, or FIG. 31.

In the event ground water should penetrate through a breach in outer tank shell 288 into interstitial space 289 between inner tank shell 210 and outer tank shell 288, the aluminum foil or other metallic element contained in this interstitial space will provide electro-chemical protection for inner tank shell 210, the aluminum or other metallic element in the interstitial space serving as a sacrificial anode to provide cathodic protection for inner steel tank shell 210. Thus, the aluminum or other metallic element in the interstitial space will preferentially oxidize rather than the iron of steel inner tank shell 210 in the presence of an oxidizing agent such as generally acidic ground water, which may be made acidic from dissolved carbon dioxide content.

Although the sacrificial anode-type intermediate barrier layer 286 is preferably in the form of overlapping foil sheeting, as an alternative the anodic metallic substance may comprise particulate metallic material substantially uniformly suspended in a noncorrosive, i.e., generally inert, flowable medium. Preferably such medium is silicone oil. An example of a suitable silicone oil for this purpose is that which is employed as a mold release agent in the fabrication of fiberglass-reinforced boat hulls. Thus, particulate aluminum, chromium, zinc, beryllium or magnesium, or any combination of these, may be suspended in the flowable inert medium to serve as sacrificial anodic material for providing cathodic protection to inner steel tank shell 210. Flowability of the inert particulate metal carrier medium material assures that fluid which may enter interstitial space 289 through a break in either inner tank shell 210 or outer tank shell 288 will flow through space 289 to one or both of monitor sensors 316.

It is to be noted that aluminum foil barrier layer 286 in completed tank 284 substantially defines interstitial space 289, which is continuous throughout the entire walls of tank 284, including the corners, except for where manways and fittings protrude. Nevertheless, applicant has found through extensive testing that any liquid delivered into interstitial space 289 at any location about the tank will seep or be ducted through interstitial space 289 to one or both of monitor sensors 316 in the bottom of the tank within about 7–40 minutes, which is extremely rapid considering that most such breaches are years in the making. Similar seepage or ducting occurs where silicone oil defines and occupies interstitial space 289, whether or not the silicone oil contains a suspension of sacrificial anodic material. Applicant has found that the amount of space within interstitial space 289 may be extremely narrow or thin, even to microscopic dimensions, and nevertheless, fluid entering a break in either tank shell will be rapidly ducted or seep to one or both monitor sensors 316.

Steel inner tank shells covered by fiber-reinforced resin outer tank shells are listed by UL (Underwriters Laboratories) as "Jacketed Underground Tank for Flammable Liquids." The "Plasteel" tanks made by Joor Manufacturing, Inc. referred to hereinabove have been approved for outer resin shell thicknesses of 0.100 inch, or 100 mils, the criterion being low hydrocarbon vapor permeability of the outer tank shell. This is considerably thinner than most manufacturers are approved for. Nevertheless, it is desirable to provide an outer fiber-reinforced resin tank shell that is even thinner than the approved 100 mil thickness, as for example, down to approximately 0.070 inch, or 70 mils. Such thinner outer resin tank shell is desirable to reduce material and application costs. It is believed that UL approval can be obtained down to 70 mils for completed tank 284, because aluminum foil barrier layer 286 is substantially completely impervious to hydrocarbon vapors. Aluminum foil sheeting 242 itself is virtually completely impervious to hydrocarbon vapors. An additional primary seal is provided by the application of adhesive aluminum foil tape over the foil sheeting overlaps as shown in FIG. 31, while a secondary seal is provided by the resin of outer shell 288.

Aluminum foil intermediate barrier layer 286, being very thin, provides interstitial monitoring space 289 which is similarly very thin. The actual monitoring volume here is very small, and this in turn renders the monitoring function extremely sensitive. Monitoring in tank 284 is sensitive to pints or less of liquid entering interstitial space 289, which is a whole order of magnitude less than the many gallons of liquid required in the interstitial monitoring area in prior art systems. Thus, a relatively minor breach in either inner tank shell 210 or outer tank shell 288 will be detected an order of magnitude sooner in the present system than in prior art systems. This same advantage will hold true where other metal foils higher on the electromotive series than iron are employed for foil barrier layer 286. This advantage will also hold true where intermediate barrier layer 286 is a flowable inert medium such as silicone oil, with or without sacrificial anode particulate metal suspended therein, in which case interstitial space 289 would be generally similarly thin as when aluminum foil is employed for barrier layer 286.

If it is not desired to provide cathodic protection, intermediate barrier layer 286 may comprise a flowable, inert medium such as silicone oil without the particulate metal therein. Regardless of whether the particulate metal is present in the flowable medium such as silicone oil, monitor senors 316 are selected so as to not be sensitive to this flowable medium. Thus, monitor sensors 316 are selected to be sensitive to both hydrocarbon liquid and vapor, and water, but not the flowable medium such as silicone.

FIG. 31 illustrates a completed tank 284 which is the same as tank 284 illustrated in FIGS. 28–30 except that intermediate foil barrier layer 320 is not helically wrapped around cylindrical body 212 of inner tank shell 210, but is instead employed in a series of overlapping hoops 322 of the aluminum foil sheeting. The ends of each hoop 322 also overlap each other. Where foil hoops 322 successively overlap each other, and the individual hoop ends overlap each other, the overlaps are provided with a primary vapor seal of adhesive aluminum foil tape 324. Such aluminum foil tape is commercially available with pressure sensitive adhesive on one side, and this adhesive side faces foil hoops 322 to provide the vapor seals at the overlaps. Secondary vapor sealing is then provided by the resin of outer shell 288. While the aluminum foil tape is shown in FIG. 31 as applied to the hoop form of foil sheeting deployment, it is to be understood that the foil tape is equally applicable to the helical from of foil sheeting, being helically applied over the helical overlapping.

Figure 32:
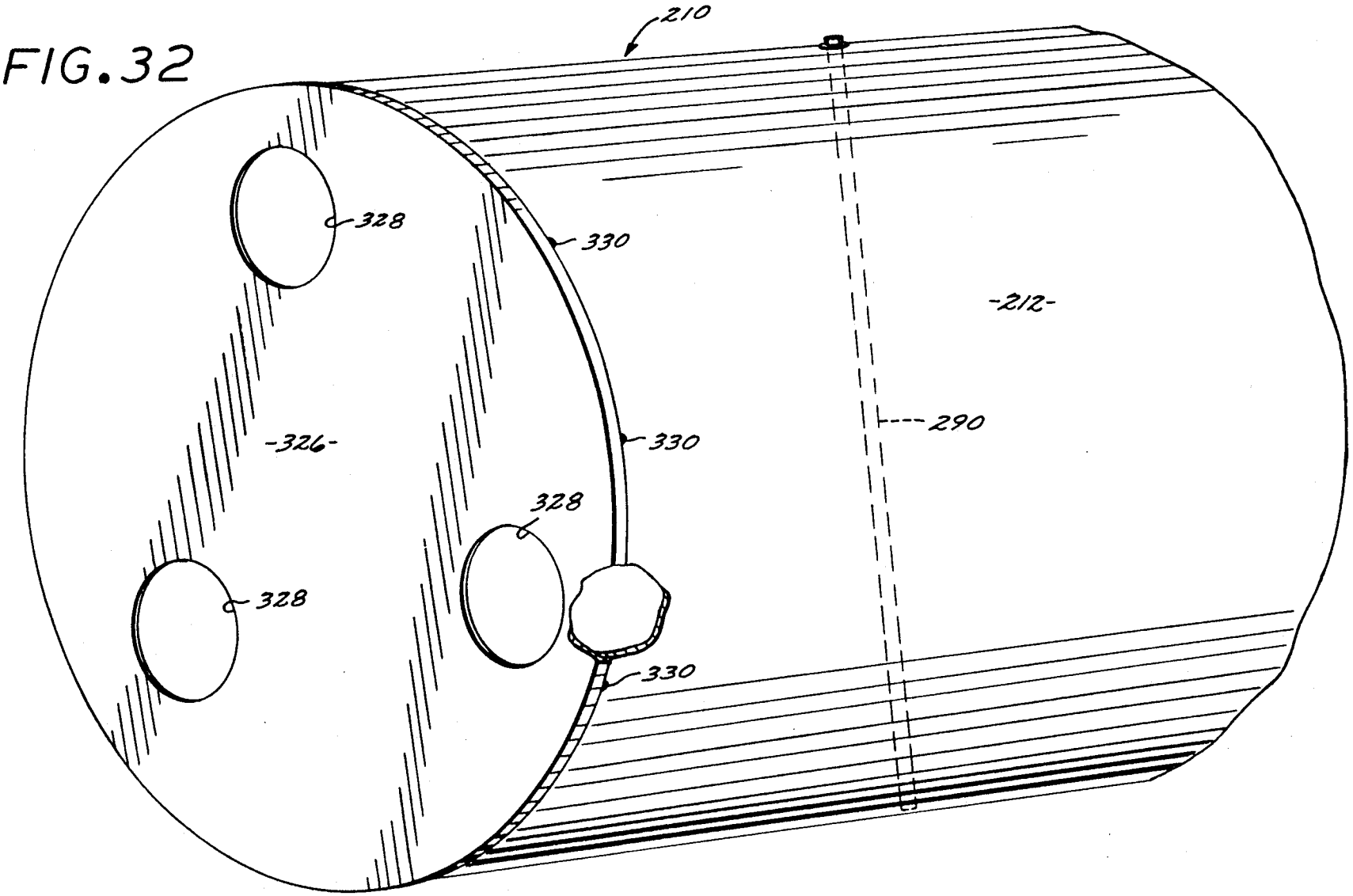
FIG. 32 is a perspective view, with portions broken away, illustrating an inner tank shell of the invention during fabrication, with an apertured temporary production fixture at one end for supporting the cylindrical tank shell configuration while allowing worker access into the shell for internally welding the lower ends of the monitor pipe struts to the inner surface of the shell.

FIG. 32 illustrates inner tank shell 210 while under construction. Cylindrical body 212 has been made, and one of the end heads 214 or 216 welded in place. Monitor pipe struts 290 and 292 are in the process of being installed, which requires that welds 300 which attach the lower ends of monitor pipe struts 290 and 292 be made in the inside of shell 210 for maximum weld strength. It is essential that cylindrical body 212 be maintained as a round cylindrical barrel during installation of monitor pipe struts 290 and 292. For this purpose, a temporary production fixture head is tack-welded to the end of cylindrical body 212 which has not already had a head 214 or 216 welded into place. This production fixture is generally designated 326, and it has a plurality of crawl holes 328 extending through it, through which a welder can enter the interior of shell 210. These crawl holes 328 are preferably three in number and regularly spaced around production fixture 326 so that one of them will always be low enough for easy entry by the worker, regardless of the rotational orientation of tank shell 210, with the cylindrical axis of shell 210 generally horizontally oriented. Tack welds 330 hold production fixture 326 in position until monitor pipe struts 290 and 292 are installed, at which time production fixture 326 is removed and replaced by the other of the two end heads 214 and 216.

Thus, the "blank" inventory tanks referred to hereinabove contain the considerable added structural strength of the monitor pipe struts for further handling, including the installation of one or more manways and function pipe fittings.

While the present invention has been described with reference to presently preferred embodiments and fabricating procedures, it is to be understood that various modifications or alterations in the double wall tank structures of the invention or the fabricating procedures may be made by those skilled in the art without departing from the scope and spirit of the invention as set forth in the appended claims.

I claim:

1. A double wall fluid storage tank, which comprises:

a generally rigid primary fluid containment inner tank shell;

a generally rigid secondary fluid containment outer tank shell generally surrounding said inner tank shell; and an intermediate barrier layer comprising metal foil sheeting between said inner and outer tank shells defining secondary containment space means between said inner and outer shells, with said outer shell being supported on said barrier layer;

said secondary containment space means conducting fluid which may enter such space means to monitor sensor means which has access to said secondary containment space means;

said inner tank shell comprising steel, and the metal of said metal foil having a higher electrode potential on the electromotive force series of elements than iron so as to provide cathodic protection for said inner tank shell.

2. A double wall tank as defined in claim 1, wherein the metal of said metal foil is selected from the group of metals consisting of aluminum, chromium, zinc, beryllium and magnesium.

3. A double wall tank as defined in claim 1, wherein said metal foil comprises aluminum foil.

4. A double wall tank as defined in claim 1, wherein said outer tank shell comprises fiber-reinforced resin.

5. A double wall tank as defined in claim 3, wherein said outer tank shell comprises fiber-reinforced resin.

6. A double wall tank as defined in claim 5, wherein said inner and outer tank shells are generally cylindrical in configuration, having generally cylindrical body portions and end head closures;

said aluminum foil sheeting being in the form of a series of overlapping hoops along said cylindrical body portion of said inner shell, and said aluminum foil sheeting being applied over said end head closures of said inner shell in overlapping sheets;

said overlapping aluminum foil sheeting providing a substantial vapor barrier surrounding said inner shell.

7. A double wall tank as defined in claim 6, which comprises adhesive aluminum foil tape over said overlapping which provides a substantial vapor seal proximate the foil sheeting overlapping.

8. A double wall tank as defined in claim 6, wherein the resin of said outer tank shell provides a substantial vapor seal proximate the foil sheeting overlapping.

9. A double wall tank as defined in claim 7, wherein the resin of said outer tank shell provides secondary vapor sealing proximate the foil sheeting overlapping.

10. A double wall tank as defined in claim 5, wherein said inner and outer tank shells are generally cylindrical in configuration, having generally cylindrical body portions and end head closures;

said aluminum foil sheeting being generally helically wound on said cylindrical body portion of said inner shell with adjacent loops of the helix overlapping, and said aluminum foil sheeting being applied over said end head closures of said inner shell in overlapping sheets;

said overlapping aluminum foil sheeting providing a substantial vapor barrier surrounding said inner shell.

11. A double wall tank as defined in claim 10, which comprises adhesive aluminum foil tape over said overlaps which provides a substantial vapor seal proximate the foil sheeting overlapping.

12. A double wall tank as defined in claim 10, wherein the resin of said outer tank shell provides a substantial vapor seal proximate the foil sheeting overlapping.

13. A double wall tank as defined in clam 11, wherein the resin of said outer tank shell provides secondary vapor sealing proximate the foil sheeting overlapping.

14. A double wall fluid storage tank, which comprises:

a generally rigid primary fluid containment inner tank shell;

a generally rigid secondary fluid containment outer tank shell generally surrounding said inner tank shell; and an intermediate barrier layer consisting essentially of a generally inert, flowable liquid medium between said inner and outer shells defining secondary containment space means between said inner and outer shells, with said flowable liquid medium being supported on said inner shell and said outer shell being supported on said flowable liquid medium;

said secondary containment space means conducts fluid which may enter such space means to monitor sensor means which is substantially insensitive to said liquid medium and which has access to said secondary containment space means.

15. A double wall tank as defined in claim 14, wherein said medium comprises resin mold release agent means.

16. A double wall tank as defined in claim 14, wherein said inner tank shell comprises steel; and a substantially uniform suspension of particulate metal in said medium, said particulate metal having a higher electrode potential on the electromotive force series of elements than iron so as to provide cathodic protection for said inner tank shell.

17. A double wall tank as defined in claim 16, wherein said particulate metal is selected from the group of metals consisting of aluminum, chromium, zinc, beryllium and magnesium.

18. A double wall tank as defined in claim 16, wherein said particulate metal comprises aluminum.

19. A double wall tank as defined in claim 16, wherein said particulate metal comprises zinc.

20. A double wall tank as defined in claim 16, wherein said outer tank shell comprises fiber-reinforced resin.

21. A double wall tank as defined in claim 18, wherein said outer tank shell comprises fiber-reinforced resin.

22. A double wall tank as defined in claim 19, wherein said outer tank shell comprises fiber-reinforced resin.

23. A double wall fluid storage tank, which comprises:

a generally rigid primary fluid containment inner tank shell;

a generally rigid secondary fluid containment outer tank shell generally surrounding said inner tank shell; and an intermediate barrier layer comprising a generally inert, flowable liquid medium between said inner and outer shells defining secondary containment space means between said inner and outer shells, with said outer shell being supported on said barrier layer;

said secondary containment space means conducting fluid which may enter such space means to monitor sensor means which is substantially insensitive to said liquid medium and which has access to said secondary containment space means;

said liquid medium comprising silicone oil.

24. A double wall fluid storage tank, which comprises:

a generally rigid primary fluid containment inner tank shell comprising steel;

a generally rigid secondary fluid containment outer tank shell generally surrounding said inner tank shell; and an intermediate barrier layer between said inner and outer shells defining secondary containment space means between said inner and outer shells; with said outer shell being supported on said barrier layer;

said secondary containment space means conducts fluid which may enter such space to monitor sensor means which has access to said secondary containment space means;

said barrier layer comprising metal having a higher electrode potential on the electromotive force series of elements than iron so as to provide cathodic protection for said inner tank shell.

25. A double wall tank as defined in claim 24, wherein said metal is selected from the group of metals consisting of aluminum, chromium, zinc, beryllium and magnesium.

26. A double wall tank as defined in claim 24, wherein said metal comprises aluminum.

27. A double wall tank as defined in claim 24, wherein said outer tank shell comprises fiber-reinforced resin.

28. A double wall tank as defined in claim 26, wherein said outer tank shell comprises fiber-reinforced resin.

29. A double wall tank as defined in claim 24, wherein said metal is in the form of metal foil sheeting.

30. A double wall tank as defined in claim 29, wherein said metal foil is aluminum foil.

31. A double wall tank as defined in claim 24, wherein said barrier layer comprises a generally inert, flowable medium, and said metal is in particulate form substantially uniformly suspended in said medium.

32. A double wall tank as defined in claim 31, wherein said metal is selected from the group of metals consisting of aluminum and zinc.

33. A double wall fluid storage tank which comprises:

a generally rigid primary containment inner tank shell which is cylindrical and comprises a generally cylindrical body with a pair of end heads;

a generally rigid secondary containment outer tank shell generally surrounding said inner tank shell;

an intermediate barrier layer between said inner and outer shells defining secondary containment space between said inner and outer shells, said secondary containment space being adapted to conduct fluid which may enter such space to monitor sensor means which has access to said secondary containment space;

said barrier layer comprising metal foil sheeting; and generally vertically, diametrically oriented monitor pipe strut means having an upper end portion which is attached to said inner shell body proximate its top and a lower end portion which is attached to said inner shell body proximate its bottom;

said monitor pipe strut means extending down through the interior of said inner shell body, with its lower end in communication with said secondary containment space proximate the bottom of said tank, and with its upper end accessible from above said outer shell to receive monitor sensor means from the top of said tank down through said monitor pipe strut means to a monitoring location proximate the bottom of said tank;

said monitor pipe strut means providing monitoring access to said secondary containment space while at the same time increasing the beam stiffness of the tank.

34. A double wall tank as defined in claim 33, wherein said metal foil sheeting is overlapping so as to provide a substantial vapor barrier surrounding said inner tank shell.

35. A double wall tank as defined in claim 34, which comprises adhesive metal foil tape over said overlapping which provides a substantial vapor seal proximate the foil sheeting overlapping.

36. A double wall tank as defined in claim 34, wherein said outer tank shell comprises resin which provides a substantial vapor seal proximate the foil sheeting overlapping.

37. A double wall tank as defined in claim 35, wherein said outer tank shell comprises resin which provides secondary vapor sealing proximate the foil sheeting overlapping.

38. A double wall tank as defined in claim 33, wherein said inner tank shell comprises steel, and the metal of said metal foil sheeting has a higher electrode potential on the electromotive force series of elements than iron so as to provide cathodic protection for said inner tank shell.

39. A double wall tank as defined in claim 38, wherein the metal of said metal foil sheeting is selected from the group of metals consisting of aluminum, chromium, zinc, beryllium and magnesium.

40. A double wall tank as defined in claim 38, wherein said metal foil comprises aluminum foil sheeting.

41. A double wall tank as defined in claim 38, wherein said outer tank shell comprises fiber-reinforced resin.

42. A double wall tank as defined in claim 40, wherein said outer tank shell comprises fiber-reinforced resin.

43. A double wall tank as defined in claim 40, wherein said aluminum foil sheeting is in the form of a series of overlapping hoops along said cylindrical body portion of said inner shell, and said aluminum foil sheeting is applied over said end head closures in overlapping sheets, said overlapping aluminum foil sheeting providing a substantial vapor barrier surrounding said inner shell.

44. A double wall tank as defined in claim 43, which comprises adhesive aluminum foil tape over said overlapping which provides a substantial vapor seal proximate the foil sheeting overlapping.

45. A double wall tank as defined in claim 43, wherein said outer tank shell comprises resin which provides a substantial vapor seal proximate said foil sheeting overlapping.

46. A double wall tank as defined in claim 44, wherein said outer tank shell comprises resin which provides secondary vapor sealing proximate the foil sheeting overlapping.

47. A double wall tank as defined in claim 40, wherein said aluminum foil sheeting is helically wound on said cylindrical body portion of said inner shell with adjacent loops of the helix overlapping, and said aluminum foil sheeting is applied over said end head closures of said inner shell in overlapping sheets;

said overlapping aluminum foil sheeting providing a substantial vapor barrier surrounding said inner shell.

48. A double wall tank as defined in claim 47, which comprises adhesive aluminum foil tape over said overlapping which provides a substantial vapor seal proximate the foil sheeting overlapping.

49. A double wall tank as defined in claim 47, wherein said outer tank shell comprises resin which provides a substantial vapor seal proximate the foil sheeting overlapping.

50. A double wall tank as defined in claim 48, wherein said outer tank shell comprises resin which provides secondary vapor sealing proximate the foil sheeting overlapping.

51. A double wall fluid storage tank, which comprises:

a generally rigid primary containment inner tank shell which is cylindrical and comprises a generally cylindrical body with a pair of end heads;

a generally rigid secondary containment outer tank shell generally surrounding said inner tank shell;

an intermediate barrier layer between said inner and outer shells defining secondary containment space means between said inner and outer shells, said secondary containment space means conducting fluid which may enter such space means to monitor sensor means which has access to said secondary containment space means; and generally vertically, diametrically oriented monitor pipe strut means having an upper end portion which is attached to said inner shell body proximate its top and a lower end portion which is attached to said inner shell body proximate its bottom;

said monitor pipe strut means extending down through the interior of said inner shell body, with its lower end in communication with said secondary containment space means proximate the bottom of said tank, and with its upper end accessible from above said outer shell to receive monitor sensor means from the top of said tank down through said monitor pipe strut means to a monitoring location proximate the bottom of said tank;

said monitor pipe strut means providing monitoring access to said secondary containment space means while at the same time increasing the beam stiffness of the tank;

said barrier layer comprising a generally inert, flowable medium.

52. A double wall tank as defined in claim 51, wherein said said medium comprises silicone oil.

53. A double wall tank as defined in claim 51, wherein said medium comprises resin mold release agent means.

54. A double wall tank as defined in claim 51, wherein said inner tank shell comprises steel; and a substantially uniform suspension of particulate metal in said medium, said particulate metal having a higher electrode potential on the electromotive force series of elements than iron so as to provide cathodic protection for said inner tank shell.

55. A double wall tank as defined in claim 54, wherein said particulate metal is selected from the group of metals consisting of aluminum, chromium, zinc, beryllium and magnesium.

56. A double wall tank as defined in claim 54, wherein said particulate metal comprises aluminum.

57. A double wall tank as defined in claim 54, wherein said particulate metal comprises zinc.

58. A double wall tank as defined in claim 54, wherein said outer tank shell comprises fiber-reinforced resin.

59. A double wall tank as defined in claim 54, wherein said outer tank shell comprises fiber-reinforced resin.

60. A double wall tank as defined in claim 57, wherein said outer tank shell comprises fiber-reinforced resin.

61. A double wall fluid storage tank which comprises:

a generally rigid primary containment inner tank shell which is cylindrical and comprises a generally cylindrical body with a pair of end heads;

a generally rigid secondary containment outer tank shell generally surrounding said inner tank shell;

said inner tank shell comprising steel and said outer tank shell comprising resin;

an intermediate barrier layer between said inner and outer shells defining secondary containment space between said inner and outer shells, said secondary containment space being adapted to conduct fluid which may enter such space to monitor sensor means which has access to said secondary containment space;

said barrier layer comprising one-sided sheet cardboard having a substantially neutral pH, said sheet cardboard having a generally flat side and a corrugated side, with said generally flat side facing said outer shell and providing a base upon which said resin outer shell is formed; and generally vertically, diametrically oriented monitor pipe strut means having an upper end portion which is attached to said inner shell body proximate its top and a lower end portion which is attached to said inner shell body proximate its bottom;

said monitor pipe strut means extending down through the interior of said inner shell body, with its lower end in communication with said secondary containment space means proximate the bottom of said tank, and with its upper end accessible from above said outer shell to receive monitor sensor means from the top of said tank down through said monitor pipe strut means to a monitoring location proximate the bottom of said tank;

said monitor pipe strut means providing monitoring access to said secondary containment space means while at the same time increasing the beam stiffness of the tank.

62. A double wall tank as defined in claim 61, wherein said cardboard has the characteristic of dissolving or otherwise breaking down when exposed to fluid potentially to be sensed.

* * * * *